US009714804B2

(12) United States Patent
Singh

(10) Patent No.: US 9,714,804 B2
(45) Date of Patent: Jul. 25, 2017

(54) FIREARM WITH SAFE AXIS FIRING PIN AND CENTER ALIGNED BARREL

(71) Applicant: Rajpreet Singh, Bellevue, WA (US)

(72) Inventor: Rajpreet Singh, Bellevue, WA (US)

( * ) Notice: Subject to any disclaimer, the term of this patent is extended or adjusted under 35 U.S.C. 154(b) by 0 days.

(21) Appl. No.: 15/139,220

(22) Filed: Apr. 26, 2016

(65) Prior Publication Data

US 2016/0320155 A1 Nov. 3, 2016

Related U.S. Application Data

(60) Provisional application No. 62/155,896, filed on May 1, 2015.

(51) Int. Cl.

| | |
|---|---|
| ***F41A 17/72*** | (2006.01) |
| ***F41A 17/70*** | (2006.01) |
| ***F41A 19/13*** | (2006.01) |
| ***F41A 19/11*** | (2006.01) |
| ***F41A 19/12*** | (2006.01) |

(52) U.S. Cl.

CPC ..... *F41A 17/70* (2013.01); *F41A 17/72* (2013.01); *F41A 19/11* (2013.01); *F41A 19/12* (2013.01); *F41A 19/13* (2013.01)

(58) Field of Classification Search

CPC ..... F41A 17/64; F41A 17/72; F41A 15/00–15/16; F41A 19/06; F41A 19/13; F41A 19/23; F41A 19/25–19/27; F41A 17/24; F41A 17/66

USPC ..... 42/69.01–69.03, 70.08

See application file for complete search history.

(56) References Cited

U.S. PATENT DOCUMENTS

| | | | | |
|---|---|---|---|---|
| 384,277 A | | 6/1888 | Pope | |
| 1,377,629 A | * | 5/1921 | Rosebush | F41A 11/02 42/75.03 |
| 2,606,384 A | * | 8/1952 | Perry | F41A 15/08 42/25 |
| 3,050,894 A | * | 8/1962 | Ivy | F41A 19/13 102/444 |
| 3,352,046 A | | 11/1967 | Warner et al. | |

(Continued)

OTHER PUBLICATIONS

International Search Report and Written Opinion mailed Jul. 25, 2016, issued in corresponding Application No. PCT/US2016/029395, filed Apr. 26, 2016, 8 pages.

*Primary Examiner* — Stephen M Johnson
*Assistant Examiner* — Benjamin Gomberg
(74) *Attorney, Agent, or Firm* — Christensen O'Connor Johnson Kindness PLLC

(57) ABSTRACT

Systems for a firearm are provided to increase safety, reduce complexity, and improve precision of the weapon. In general, examples of the systems including a safe axis firing pin that prevents unintended discharge are described herein, where the firing pin is not aligned with the primer of a chambered cartridge until the user intends to fire the firearm. Embodiments of the system are capable of modular installation and generally include a user-actuated trigger configured to displace the firing pin from a safe axis to a firing axis, by rotation, translation, or a combination thereof. Additional features are provided to prevent displacement of the firing pin by input other than the trigger, e.g., if the firearm is dropped. In another aspect, examples of the systems described herein include a barrel interfacing a slide where the barrel and slide include features to centrally align the barrel as the slide completes a cycle.

27 Claims, 21 Drawing Sheets

(56) References Cited

U.S. PATENT DOCUMENTS

| | | | | |
|---|---|---|---|---|
| 3,545,116 | A | 12/1970 | Babington | |
| 4,341,031 | A * | 7/1982 | Palmer | F41A 3/10 42/23 |
| 4,539,889 | A | 9/1985 | Glock | |
| 4,589,327 | A * | 5/1986 | Smith | F41A 17/74 42/70.08 |
| 4,825,744 | A | 5/1989 | Glock | |
| 4,841,840 | A * | 6/1989 | Agner | F41A 19/13 42/70.08 |
| 5,229,539 | A * | 7/1993 | Rommel | F41A 19/13 42/69.01 |
| 5,325,760 | A * | 7/1994 | Dennis | F41A 19/36 89/25 |
| 6,257,116 | B1 * | 7/2001 | Moczijdlower | F41A 5/34 42/26 |
| 6,336,282 | B1 * | 1/2002 | Buffoli | F41A 19/14 42/66 |
| 6,665,973 | B1 * | 12/2003 | Peev | F41A 19/33 42/69.01 |
| 7,131,228 | B2 | 11/2006 | Hochstrate et al. | |
| 7,506,469 | B2 | 3/2009 | Poulin et al. | |
| 7,617,628 | B2 | 11/2009 | Curry | |
| 7,694,449 | B1 * | 4/2010 | Pontillo, II | F41A 3/26 42/71.02 |
| 7,779,740 | B1 | 8/2010 | Holmes et al. | |
| 8,015,741 | B2 * | 9/2011 | Hooks | F41A 17/46 42/70.01 |
| 2009/0071053 | A1 * | 3/2009 | Thomele | F41A 11/02 42/1.01 |

* cited by examiner

FIREARM WITH SAFE AXIS FIRING PIN AND CENTER ALIGNED BARREL

CROSS-REFERENCE TO RELATED APPLICATION

This application claims the benefit of U.S. Provisional Patent Application No. 62/155,896, filed May 1, 2015, the disclosure of which is hereby expressly incorporated by reference herein in its entirety.

BACKGROUND

Firearms with breech lock mechanisms typically use a mechanical system to fire a cartridge with integrated projectile. A cartridge generally contains gun powder in a round shell with projectile and a primer to ignite the gun powder upon striking. One type of primer striking mechanism includes a trigger actuating a firing pin, hammer, or striker. Optionally, the primer striking mechanism can simultaneously operate a recoil cartridge feeding system where the expanding gases of the ignited gunpowder cause a cycling the feeding system to load the next cartridge without the user manipulating the system. Firearms with a striking mechanism using a firing pin to ignite the primer generally provide an internal solution to operation. In this regard, the firing pin is typically included inside of the slide or upper assembly of the firearm. In contrast, a hammer striking mechanism includes moving components external to the slide or upper assembly of the firearm. Upon actuation of a trigger, the firing pin, hammer, or striker impacts the primer of the cartridge in the chamber of the barrel. The primer ignites the gun powder to propel the projectile and optionally operates the recoil cartridge feeding system.

Due to the high lethality of firearms, an assortment of safety systems are typically integrated to prevent unintended discharge of a projectile. In a firing pin striking system, various safety mechanisms exist which block the firing pin from striking the primer unintentionally. However, the tip of the pin is maintained in alignment with the primer such that unintentional movement of the firing pin may cause the primer to ignite the gun powder if the blocking piece is damaged or misaligned.

Therefore, a need exists for a mechanism that increases the safety of a firing pin striking system without detracting from the form, reliability, or function of the firearm. Embodiments of the present disclosure are directed to fulfilling these and other needs.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a firing mechanism for a firing pin-operated firearm configured to prevent unintended discharge is provided. The firing mechanism generally includes a socket and a firing pin assembly. The firing pin assembly generally includes an elongate firing pin having a shaft defining a firing pin axis, the firing pin configured to strike a primer of a cartridge with a forward tip portion; a firing pin sleeve rotatably engaging the socket and slidingly associated with the shaft of the firing pin, the sleeve configured to allow axial movement of the firing pin along the firing pin axis; and a spring abutting the firing pin sleeve for translating the firing pin along the firing pin axis. The firing mechanism generally further includes a trigger assembly configured to translate the firing pin to compress the spring and displace the firing pin assembly from a safety position wherein the firing pin axis is not aligned with the primer of the cartridge, to a firing position wherein the firing pin axis is generally aligned with the primer of the cartridge; and an extractor having a lateral protrusion positioned to prevent the firing pin assembly from inadvertently displacing from the safety position until the trigger assembly displaces the firing pin assembly.

In accordance with another embodiment of the present disclosure, a handgun with a firing pin safety mechanism is provided. The handgun generally includes a frame; a slide assembly slidable along the frame, the slide assembly having a socket and a lateral protrusion; and a firing pin assembly. The firing pin assembly generally includes an elongate firing pin having a shaft defining a firing pin axis and a firing pin protrusion selectively aligned with the lateral protrusion of the slide assembly, the firing pin configured to strike a primer of a cartridge with a forward tip portion; and a firing pin sleeve rotatably engaging the socket and slidingly associated with the shaft of the firing pin, the sleeve configured to allow axial movement of the firing pin along the firing pin axis. The handgun further generally includes a trigger assembly pinned to the frame and configured to interface the firing pin assembly within the socket and cause the firing pin to translate and the firing pin axis to displace from a safety position wherein the firing pin axis is not aligned with the primer of the cartridge, to a firing position wherein the firing pin axis is generally aligned with the primer of the cartridge; and wherein the lateral protrusion of the slide assembly may be positioned to prevent the firing pin assembly from inadvertently displacing from the safety position until the trigger assembly translates the firing pin and displaces the firing pin axis.

In accordance with any of the embodiments described herein, the firing pin may further include a firing pin protrusion configured to interface the lateral protrusion of the extractor to prevent the firing pin from inadvertently displacing from the safety position until the trigger assembly translates the firing pin to compress the spring.

In accordance with any of the embodiments described herein, the trigger assembly may further include a trigger hinge member; a trigger pinned to the trigger hinge member and pivotable about a trigger rotation axis; a trigger spring configured to bias the trigger towards a safety angle relative to the trigger hinge member; and a trigger interference protrusion extending from the trigger and configured to abut a body portion of the firearm, wherein the trigger hinge member may be pivotable about a trigger hinge rotation axis that is offset from the trigger rotation axis, and wherein the trigger interference protrusion may abut the body portion when the trigger hinge pivots about the trigger hinge rotation axis while the trigger is positioned at the safety angle, thereby preventing the firing pin from displacing from the safety position.

In accordance with any of the embodiments described herein, the trigger spring may return the trigger to the safety angle absent an external force acting on the trigger.

In accordance with any of the embodiments described herein, the trigger interface protrusion may include a high-friction texture on a distal end to resist slip between the trigger interface protrusion and the body portion of the firearm.

In accordance with any of the embodiments described herein, the trigger assembly may further include a trigger bar pinned to the trigger hinge member and selectively abutting the firing pin; and a trigger bar spring configured to bias the trigger bar into engagement with the firing pin, wherein the trigger bar may be configured to displace the firing pin assembly from the safety position and retract the firing pin within the firing pin sleeve a trigger bar and a trigger bar spring, the trigger bar pinned to the trigger hinge and selectively abutting the firing pin and the trigger bar configured to displace the firing pin assembly from the safety position and retract the firing pin within the firing pin sleeve, wherein the trigger bar spring may maintain the trigger bar in engagement with the firing pin until the trigger assembly reaches a rotational position that causes the firing pin to strike the primer of the cartridge.

In accordance with any of the embodiments described herein, the extractor may further include a visual indicator to alert a user the cartridge is chambered, the visual indicator configured to allow human eye perception in low or absent ambient light conditions. In accordance with any of the embodiments described herein, the displacement of the firing pin assembly from the safety position may be a rotational displacement.

In accordance with any of the embodiments described herein, the firing mechanism may be modular such that the firing mechanism is capable of installation in any suitable handgun configuration and firing any handgun caliber cartridge.

In accordance with any of the embodiments described herein, the firing mechanism may be adaptable for installation to a pistol, a handgun, a rifle, a shotgun, or the like.

In accordance with any of the embodiments described herein, the trigger assembly may further include a trigger hinge member pinned to the frame and pivotable about a trigger hinge rotation axis; a trigger pinned to the trigger hinge member and pivotable about a trigger rotation axis; a trigger spring configured to bias the trigger towards a safety angle relative to the trigger hinge member; and a trigger interference protrusion extending from the trigger, wherein the trigger hinge rotation axis may be offset from the trigger rotation axis, and wherein the trigger interference protrusion may abut the frame when the trigger hinge pivots about the trigger hinge rotation axis while the trigger is positioned at the safety angle, thereby preventing the firing pin from displacing from the safety position.

In accordance with any of the embodiments described herein, the firing pin and trigger bar spring may maintain a path of the trigger bar while the trigger hinge member pivots about the trigger hinge rotation axis such that the trigger bar may abut a surface of the frame to disengage the firing pin from the trigger bar, thereby releasing the firing pin to strike the primer.

In accordance with any of the embodiments described herein, the slide assembly may engage the trigger bar during a cycle of the slide assembly to reengage the selective abutment of the trigger bar and the firing pin.

In accordance with any of the embodiments described herein, the handgun may further include a barrel having a protrusion with a slide assembly interface surface, and a chamber inside the protrusion configured to receive the cartridge, the barrel defining a barrel axis; and a cavity in the slide assembly including a barrel protrusion interface surface, the cavity configured to closely engage the protrusion of the barrel, wherein the barrel axis may be centered laterally in the slide assembly by the abutment of the slide assembly interface surface and the barrel protrusion interface surface.

In accordance with any of the embodiments described herein, the cavity of the slide assembly may further include a breech face having a relief groove for clearance of the primer during cartridge ejection.

In accordance with any of the embodiments described herein, the handgun may further include a magazine insertable into the frame, the magazine configured to position at least one cartridge for loading into the chamber, wherein the magazine may have an asymmetrical taper at an upper end.

In accordance with any of the embodiments described herein, the slide assembly may further include a tapered barrel aperture for relief of angular rotation of the barrel axis.

In accordance with any of the embodiments described herein, the slide assembly may further include a rail groove to slidably interface a tab connected to the frame.

In accordance with any of the embodiments described herein, the rail groove may include a platform aligned with the tab of the frame and configured to restrict movement of the tab normal to the direction along the rail groove for short recoil operation of the slide assembly.

In accordance with any of the embodiments described herein, the slide assembly may include high-friction surfaces to enhance grip during manipulation of the slide assembly.

In accordance with any of the embodiments described herein, the slide assembly may include a lateral protrusion on the outer surface of the slide assembly to enhance grip during manipulation of the slide assembly.

In accordance with any of the embodiments described herein, the handgun may further include a lever insertable into the slide assembly and configured to transition the handgun to full automatic operation.

In accordance with any of the embodiments described herein, the frame may include a grip portion including a slot for interfacing a groove in a strap, the strap including a strap spring, wherein the strap may integrate as part of the grip portion when secured, and wherein the strap spring may be configured to secure a strap pin to the frame.

In accordance with any of the embodiments described herein, the strap may be configured to allow a user to adjust the sizing of the grip portion.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
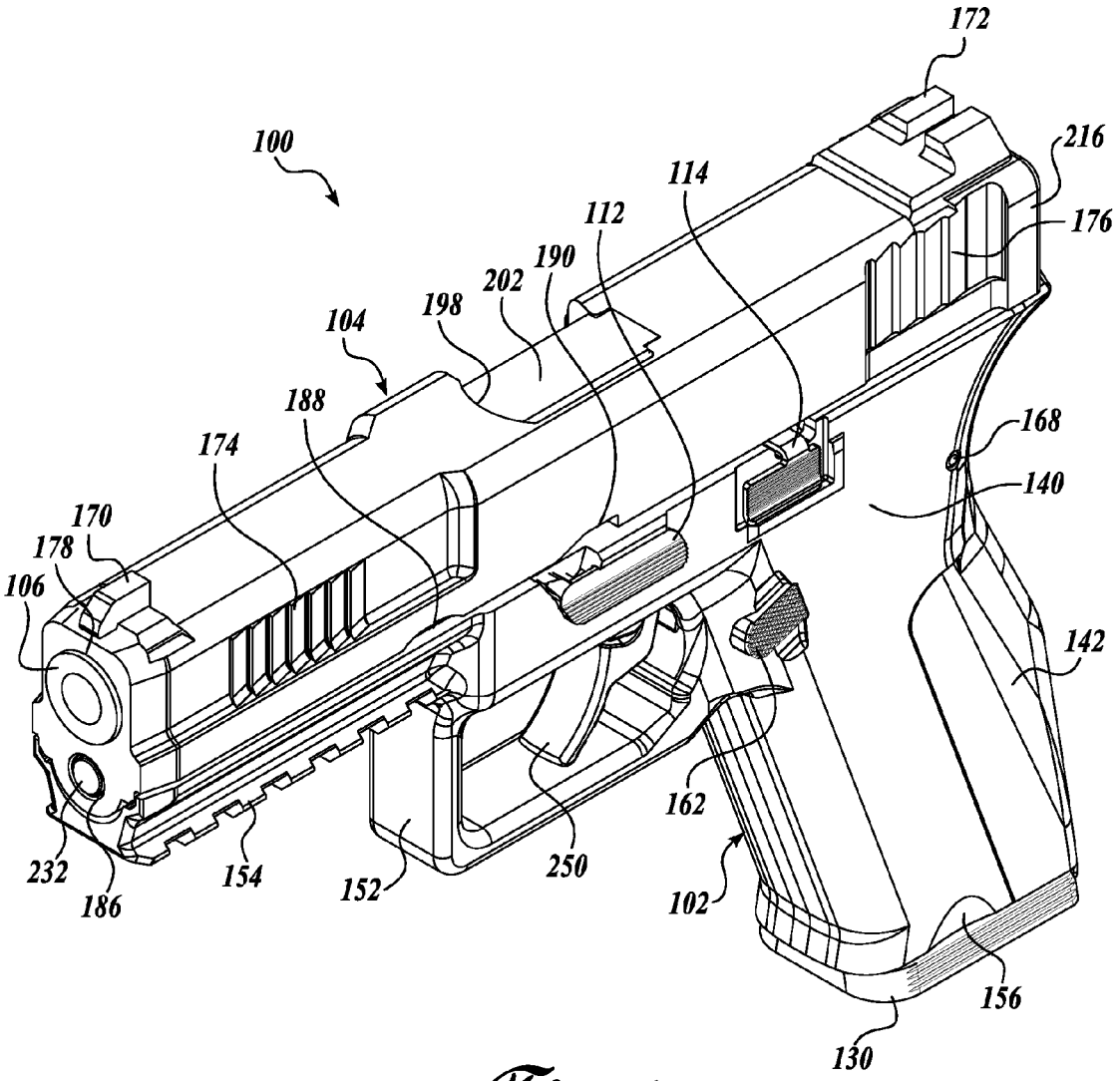
FIG. 1 is a front right top perspective view of a handgun with a safety mechanism formed in accordance with one embodiment of the present disclosure.
Figure 2:
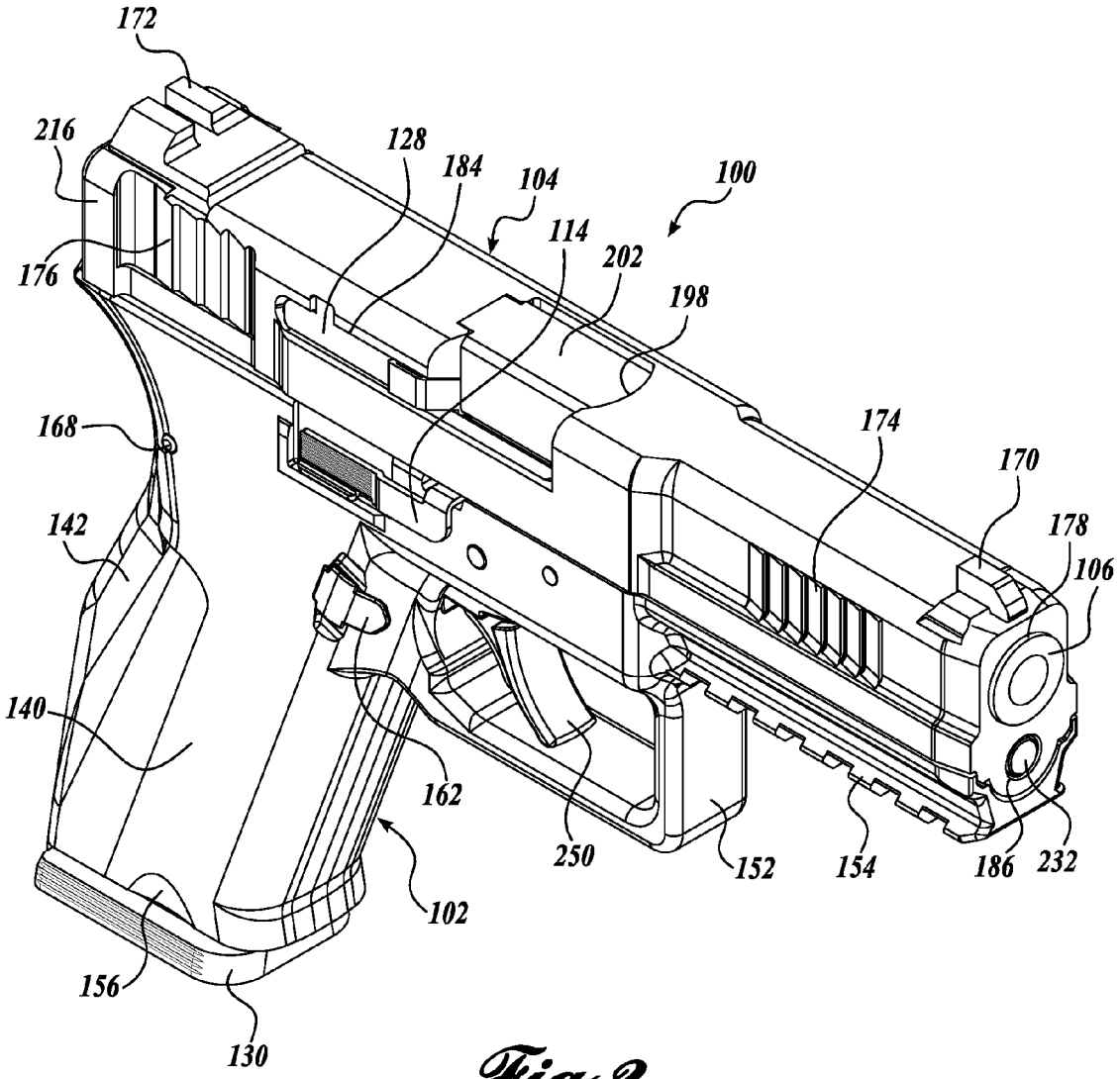
FIG. 2 is a front left top perspective view of the handgun of FIG. 1.
Figure 3:
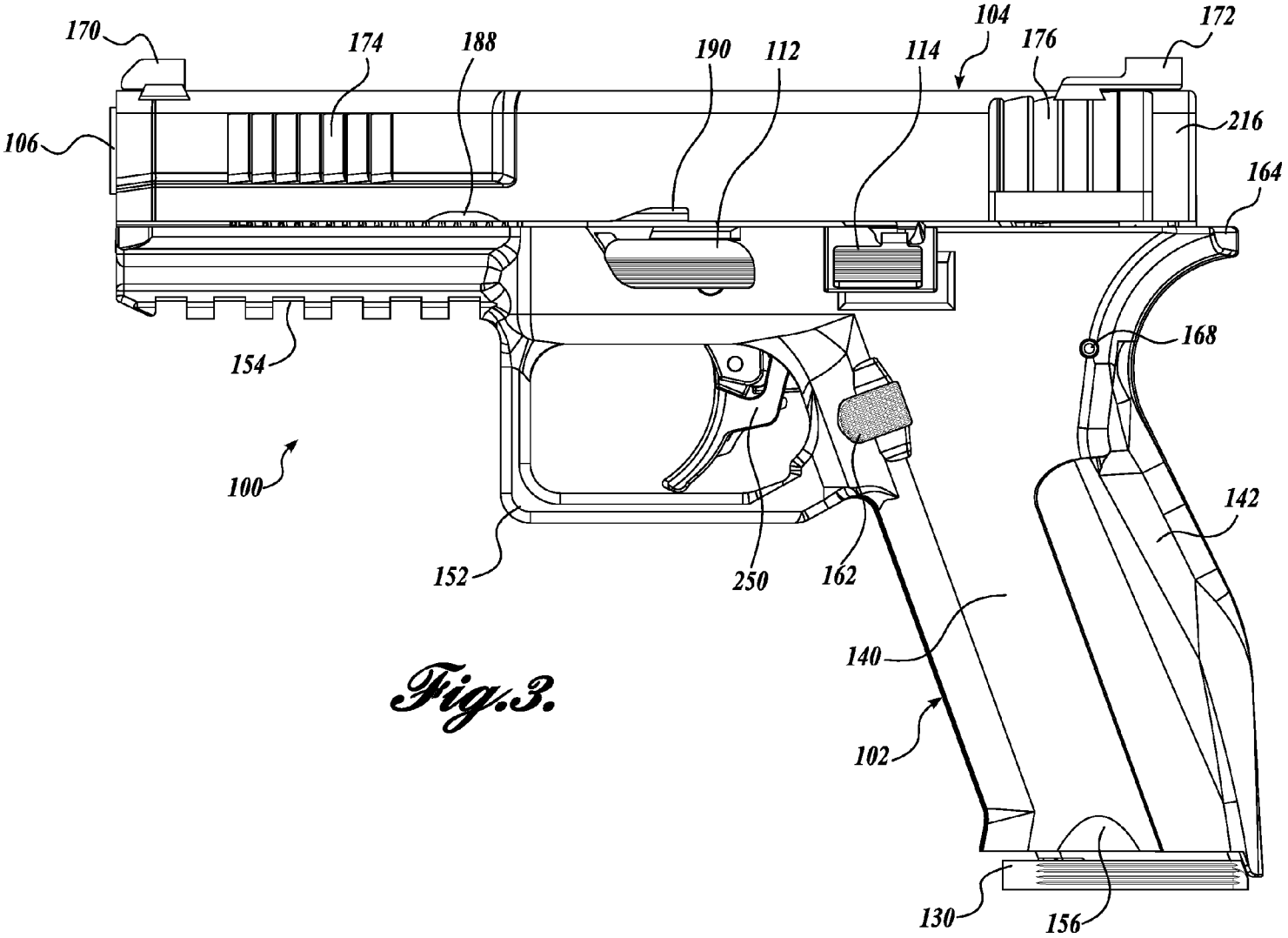
FIG. 3 is a right elevational view of the handgun of FIG. 1.
Figure 4:
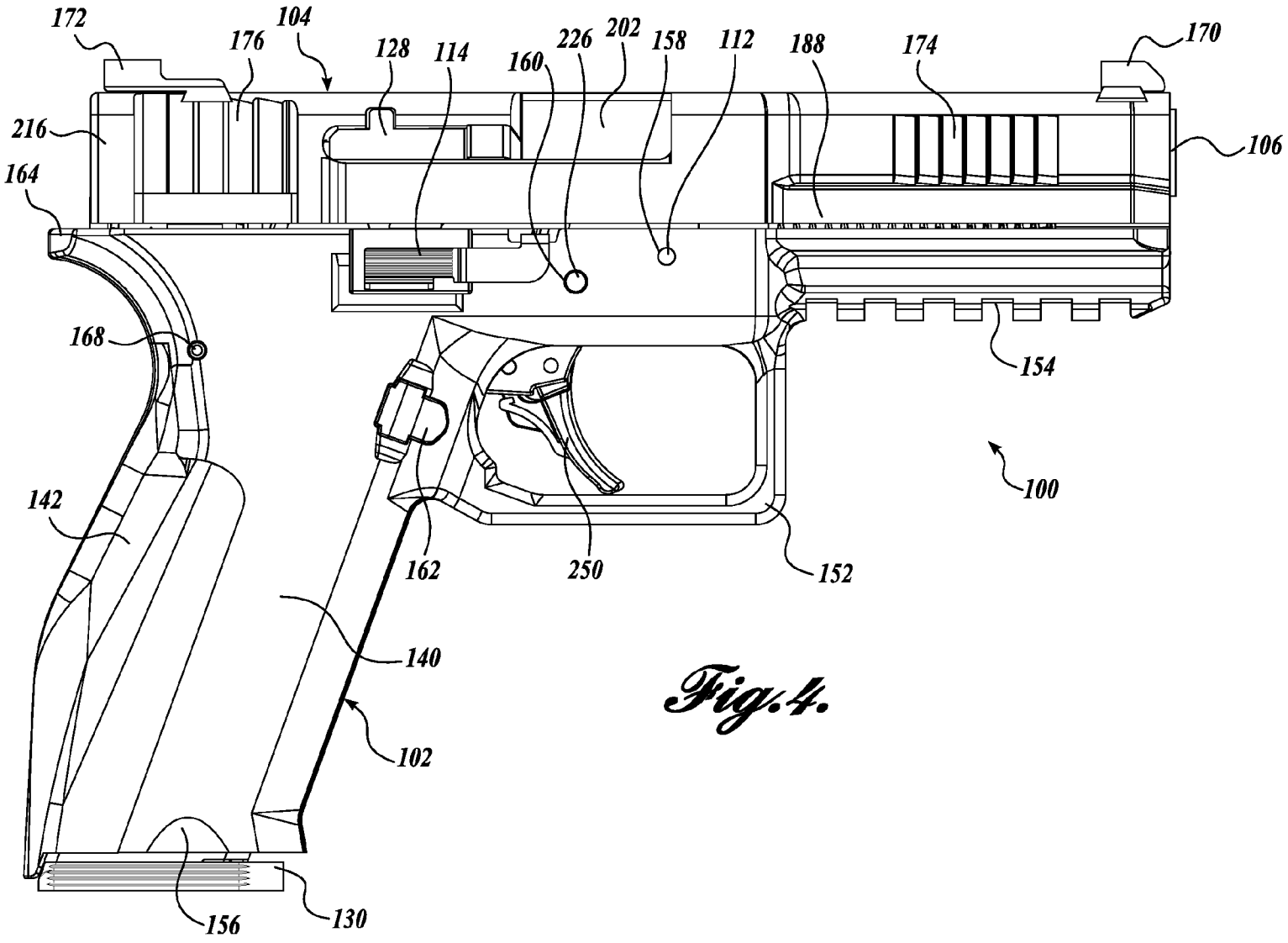
FIG. 4 is a left elevational view of the handgun of FIG. 1.

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein are interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order to not unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

Embodiments of the present disclosure are generally directed to systems for improving function, safety, accuracy, precision, form, reliability, and/or durability of a firearm. In general, examples of the systems herein are capable of integration with a wide variety of firearms, including rifles, pistols, shotguns, etc., and a wide variety of cartridge calibers. In this regard, the embodiments herein are modular such that the systems can be installed in any suitable handgun configuration. Additionally, the systems of the embodiments herein are capable of adaptation for implementation in a variety of firearms. As such, adaptation may consist of resizing or repackaging of components while remaining within the scope of the present disclosure. Further, although the descriptions herein refer to components commonly associated with handguns, such as a slide, the embodiments of the disclosure herein are suitably adapted for use with firearms that do not include a slide, such as a bold action rifle, commonly using a bolt carrier group, the bolt action including both manual and automated mechanisms.

Additionally, embodiments described herein are capable of operation in conjunction with other systems of the firearm without detracting from the function of the other systems. Although the systems herein are capable of wide application, the FIGURES and descriptions are generally directed to pistols and calibers of the type employing a firing pin in a primer striking mechanism. In this regard, a handgun caliber is one suitable for use in a handgun. In the present disclosure, the term "firing pin" is used to represent the primer striking mechanism. In this regard, "firing pin" is meant to interchangeably represent any primer striking mechanism suitable for use with the embodiments herein. As one example, the term "striker" is also commonly used to represent the primer striking mechanism and should be considered interchangeable with "firing pin" herein.

Referring to FIGS. 1-4, a handgun 100 formed in accordance with one embodiment of the present disclosure is provided. The handgun 100 is generally of the type employing a firing pin primer striking mechanism. However, in other embodiments, any suitable striking mechanism is used to ignite the primer of the cartridge. The handgun 100 generally includes a frame 102, a slide 104, a barrel 106, a slide lock rod 112, a slide stop 114, an extractor 128, and a magazine 130. In the embodiments herein, aspects and features related to the present disclosure are described in relation to a handgun of the type shown in the FIGURES; however, certain of the aspects and features are also suitably applied to other types of firearms.

Figure 22:
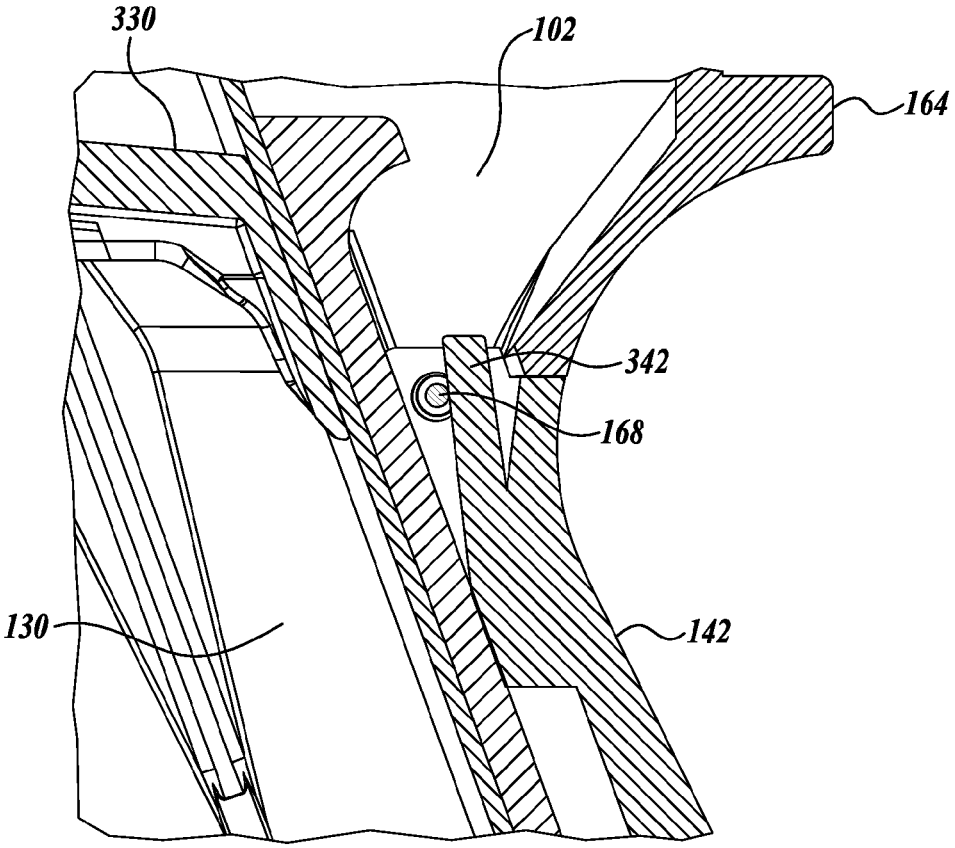
FIG. 22 is a detail sectional side view of the grip and grip strap of the handgun of FIG. 1.

The frame 102 of the handgun 100 includes a grip 140, a grip strap 142, a trigger guard 152, an accessory rail 154, a tapered magazine recess 156, a magazine release button 162, a rear extension 164, and a grip strap pin 168. The grip 140 and the grip strap 142 cooperatively provide a surface for a user of the handgun 100 to grab the frame 102 while shooting. In this regard, the grip 140 and grip strap 142 include ergonomic features to enhance the tactile feel and effectiveness of the grip on the handgun 100. In one embodiment, the grip strap 142 is secured to the frame 102 with a grip strip rail (not shown) corresponding to a grip strap slot (not shown) in the grip 140. When the grip strap 142 is slid into place, the grip strap 142 is secured to the grip 140 using the grip strap pin 168 through a grip strap aperture (not shown) and an aft trigger housing aperture 274 (see FIGS. 10 and 11). In a further embodiment shown in FIG. 22, the grip strap 142 includes a grip strap spring 342 to retain the grip strap pin 168 in the frame 102. In some embodiments, the grip strap spring 342 is integral to the grip strap 142. In other embodiments, the grip strap spring 342 is suitably a separate component interfacing the grip strap 142 to retain the grip strap pin 168. To interface the grip strap spring 342 for retention, the grip strap pin 168 includes a grip strap pin recess 348 (FIGS. 8 and 9) at a central location of the grip strap pin 168 and aligned with the grip strap spring 342 in the installed position of the grip strap pin 168. In other embodiments, the grip strap 142 is secured to the grip 140 using any suitable method, including multiple pins, tongue and groove, fasteners, and the like.

In some embodiments, the grip strap 142 is manufactured in different shapes and thicknesses to allow the user to customize the grip dimensions and shape to the user's preference, for example, to accommodate differing hand shapes and sizes. In other embodiments, the grip 140 may omit the grip strap 142 such that the grip 140 is a single piece. In further embodiments, the grip 140 may include more than one removable portion, e.g., forward and rear grip straps, side grip straps, etc.

Another component of the frame 102, the trigger guard 152, protects a trigger 250 from unintentional actuation, such as when the handgun 100 is dropped or placed in a holster (not shown). The frame 102 also includes the accessory rail 154 for attaching certain generic accessories, for example, a flashlight, a laser, a locking mechanism, an accessory rail extension, and the like. Further, the frame 102 includes the tapered magazine recess 156 to provide access for the user to pull the magazine 130 away from the frame 102 after pressing the magazine release button 162 from either side of the handgun 100. The frame also includes the rear extension 164 to provide a comfortable upper limit to the hand of the user on the grip 140. In this regard, the rear extension 164 protects the user from gripping the handgun 100 in an area where the slide 104 may contact the user's hand and cause injury.

In this embodiment, the slide 104 of the handgun 100 includes a front sight 170, a rear sight 172, forward grooves 174, aft grooves 176, a forward barrel aperture 178, an extractor slot 184, a spring rod aperture 186, a slide lock relief 188, a slide stop cut 190, a barrel protrusion interface surface 198, and one or more slide grip protrusions 216. The front sight 170 and rear sight 172 are adjustably aligned with the barrel 106 to allow the user to aim the handgun 100 at a target. The forward grooves 174 and the aft grooves 176 provide an area of increased friction on the slide 104 and the slide grip protrusion 216 provides an extended surface to provide a further location of increased friction. In this regard, the forward grooves 174, the aft grooves 176, and the slide grip protrusion 216 are configured such that the user can grip the slide 104 for cycling the slide 104 during arming and unarming of the handgun 100. In this regard, the aft grooves 176 and the slid grip protrusion 216 provide a suitable location for the user to cycle the slide 104. In some embodiments, the width of the slide 104 is larger such that the thickness of the slide 104 allows a larger cut of the aft grooves 176 to create the slide grip protrusion 216 and provide further grip features for the user while cycling the slide 104.

Figure 20:
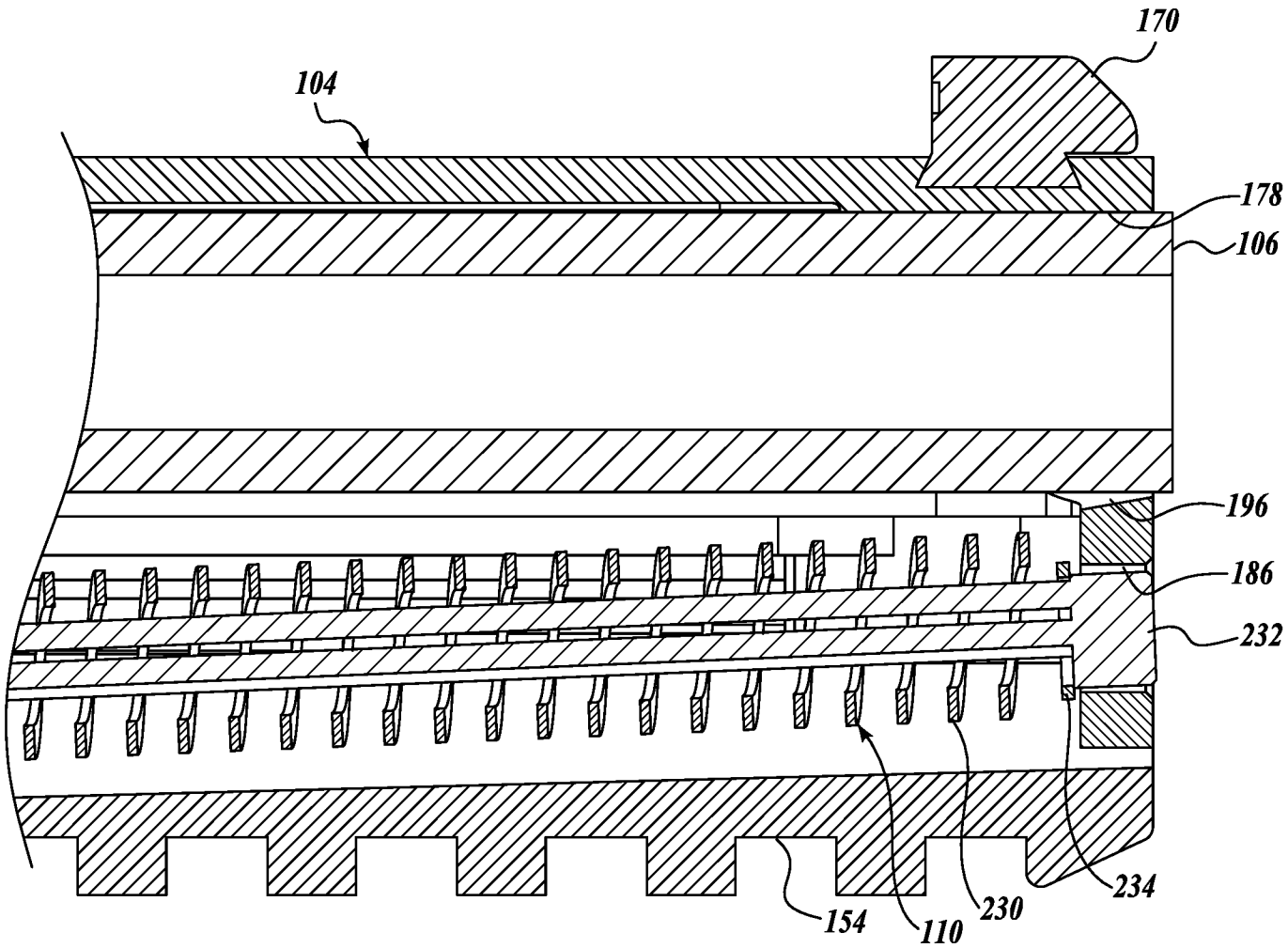
FIG. 20 is a detail sectional side view of the forward end of the handgun of FIG. 1, showing the frame, barrel, slide, and a main spring assembly.

The forward barrel aperture 178 and the spring rod aperture 186 provide pass-through of the barrel 106 and a spring rod 232, respectively, while the slide 104 cycles rearward on the frame 102. In this regard, the barrel 106 and the spring rod 232 do not travel rearward in the same manner and distance as the slide 104. As a result, the barrel 106 and the spring rod 232 slide through the forward barrel aperture 178 and the spring rod aperture 186, respectively, while the slide 104 cycles. In some embodiments, as the slide 104 cycles, the barrel 106 is tilted at an angle to provide clearance for a barrel cavity 182 of the slide 104 to pass over a barrel protrusion 202 of the barrel 106. Turning briefly to FIG. 20, a cross section of the forward area of the frame 102 and the slide 104 is shown. In an additional aspect of the slide 104, the forward barrel aperture 178 includes a forward barrel aperture relief surface 196 tapered at an angle. The forward barrel aperture relief surface 196 allows the forward barrel aperture 178 to more closely engage the barrel 106 while providing relief for the tilting of the barrel 106 during the cycling of the slide 104.

In a further aspect of the slide 104, the slide lock relief 188 and the slide stop cut 190 are cut into the slide 104. The slide stop cut 190 provides a location for the slide stop 114 to engage the slide 104 and stop the forward travel after the slide 104 reaches its rearward position. In this regard, the slide 104 stops at an intermediate point of the full cycle, known as an open position of the slide 104. When the slide 104 is stopped by the slide stop 114, the slide lock relief 188 allows the rotation of the slide lock rod 112 (also generally known as a take down lever). In general, for the type of handgun 100, rotating the slide lock rod 112 unlocks the slide 104 such that the slide 104 can be removed from the frame 102 by sliding the slide 104 forward and away from the frame 102. In another aspect of the illustrated embodiments, the slide lock rod 112 covers a locking block aft pin 226 (see FIG. 8) to prevent removal until the slide lock rod 112 is rotated to uncover the locking block aft pin 226. In some embodiments, the slide stop 114 can be articulated manually to stop the slide 104 in the open position. In other embodiments, the slide stop 114 automatically stops the slide 104 in the open position after the final cartridge in the magazine 130 is spent. In this regard, upon exchanging the empty magazine 130 with a magazine 130 containing unspent cartridges, the user can actuate the slide stop 114 from either side of the handgun 100 to finish the cycle of the slide 104 while simultaneously arming the handgun 100 by placing a cartridge in firing position.

Figure 17:
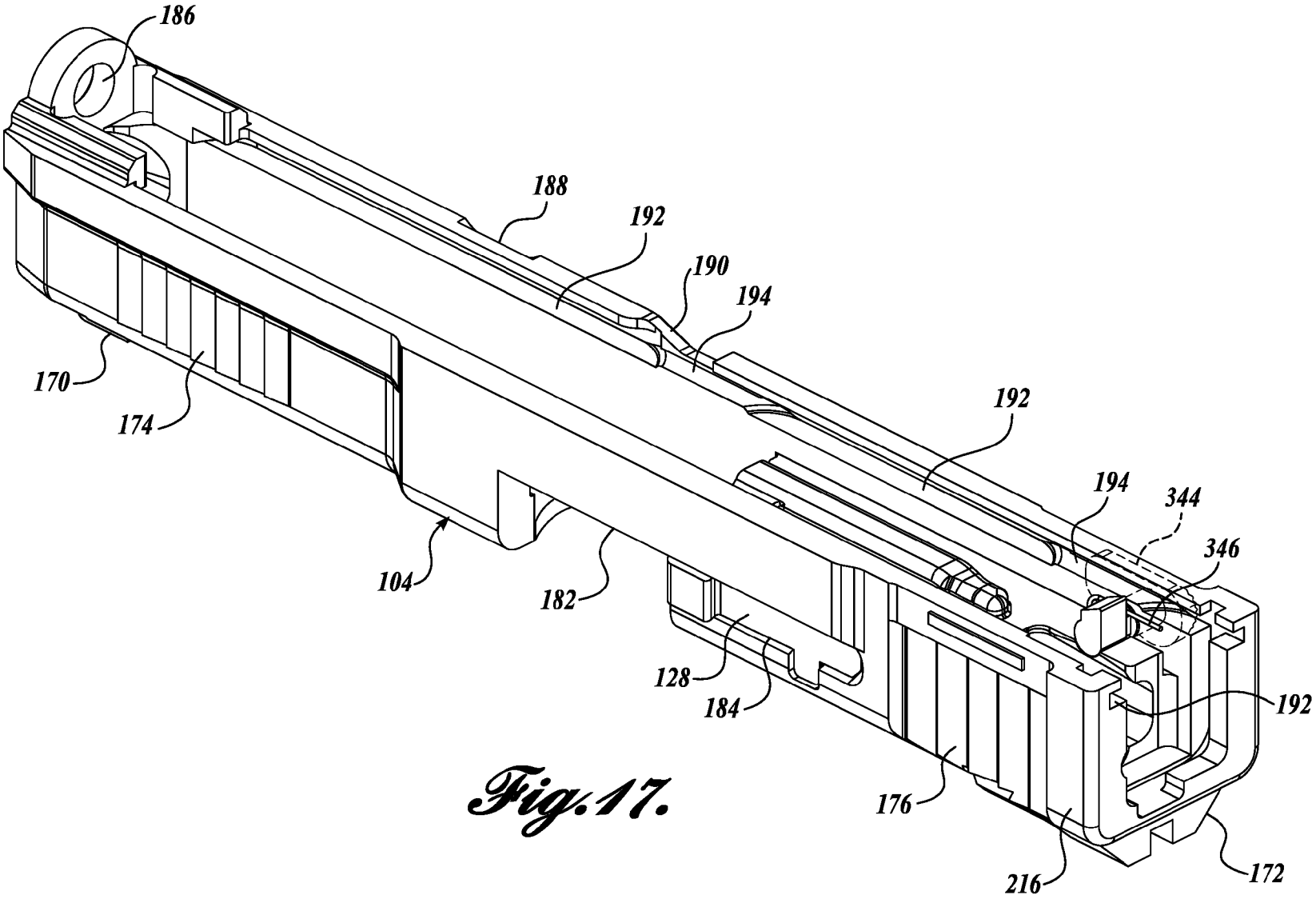
FIG. 17 is an inverted perspective view of the slide of the handgun of FIG. 1, showing features of the slide and components for full automatic operation.
Figure 18:
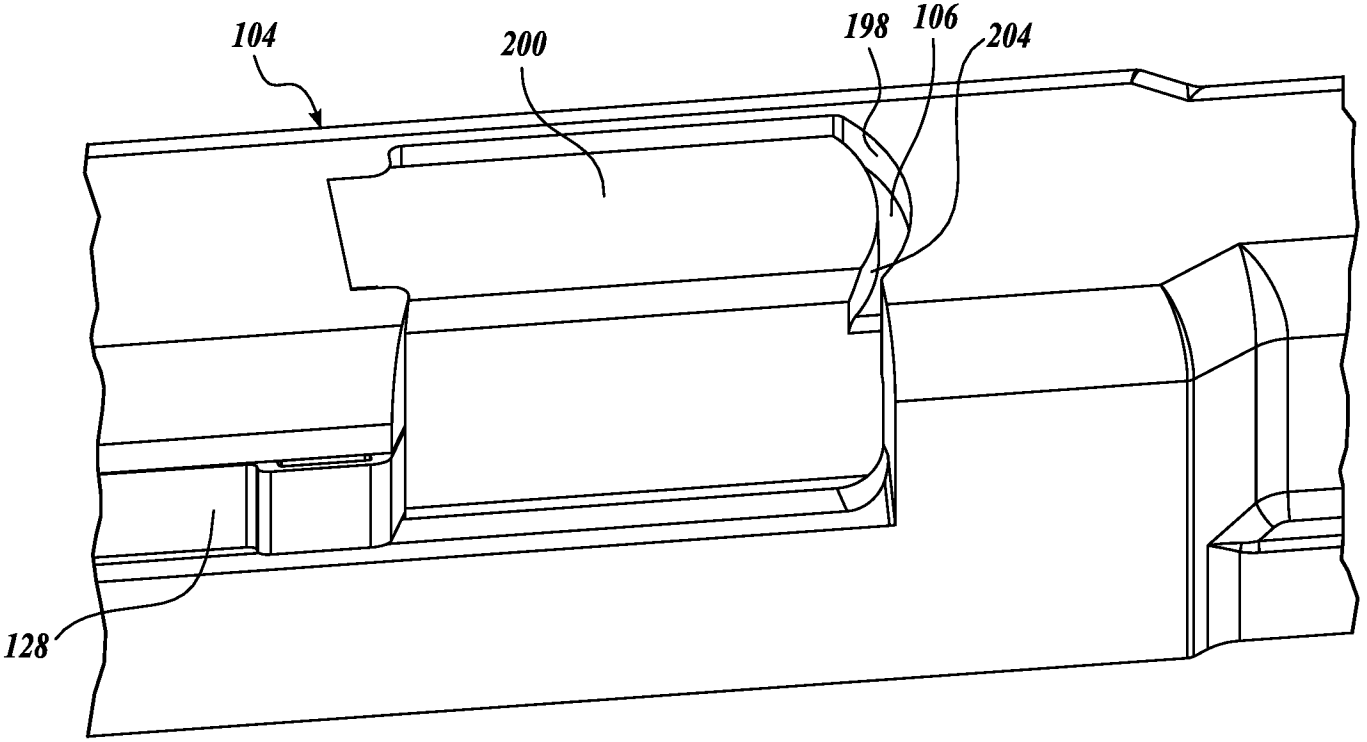
FIG. 18 is a detail view showing a portion of a protrusion of the barrel and a barrel cavity of the slide of the handgun of FIG. 1.
Figure 19:
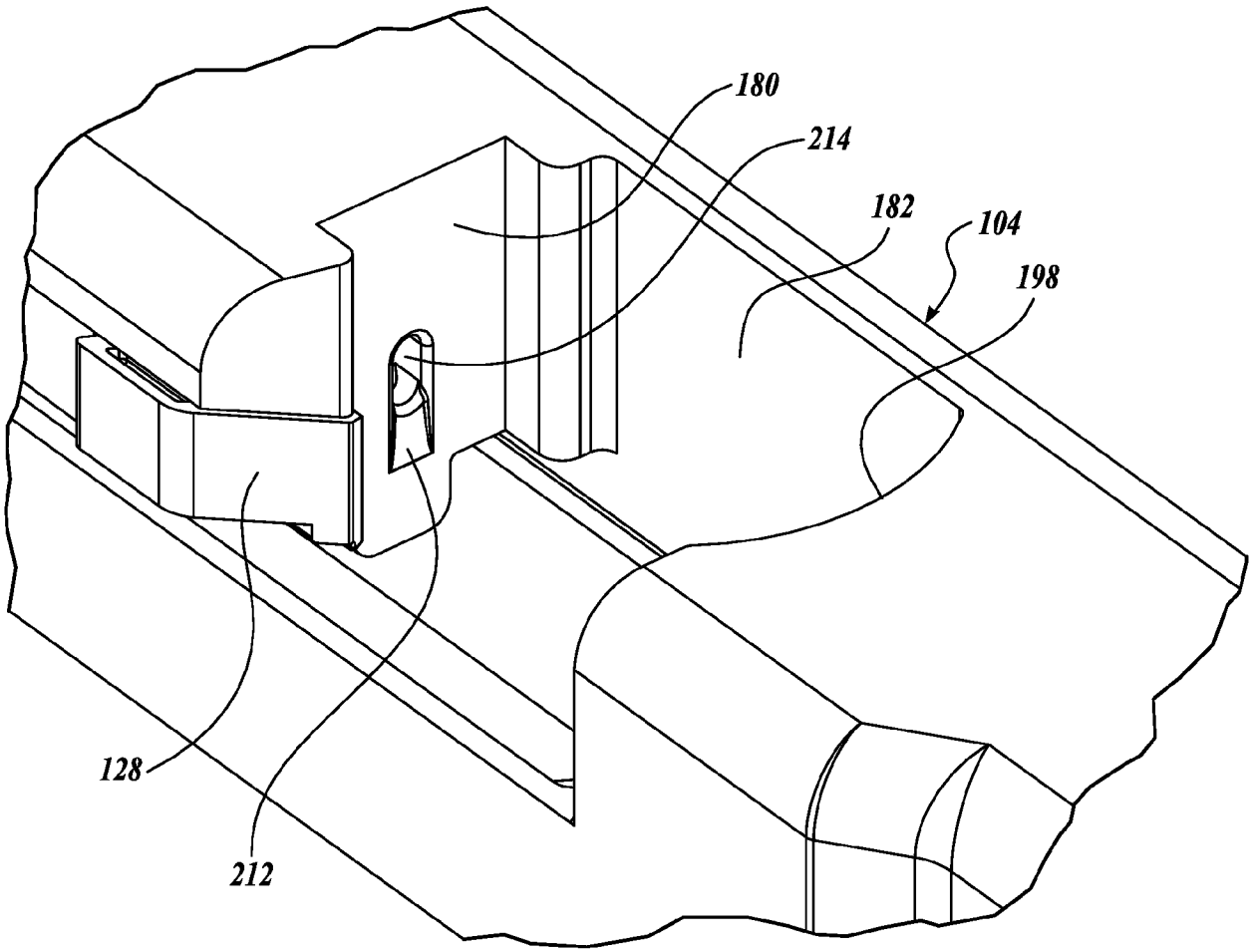
FIG. 19 is a detail view showing a portion of the slide of the handgun of FIG. 1.

Turning now to FIGS. 17-19, further aspects of the slide 104 will be described in more detail. The slide 104 includes a breech face 180 (FIG. 19), the barrel cavity 182, the extractor slot 184, rail grooves 192 (FIG. 17), rail groove platforms 194 (FIG. 17), a breech face relief recess 212 (FIG. 19), a firing pin breech face aperture 214 (FIG. 19), a full automatic lever 344 (FIG. 17), and a full automatic lever spring clip 346 (FIG. 17). The rail grooves 192 provide a sliding interface that engages components shown most clearly in FIG. 5, including a forward slide groove tab 166 of the frame 102, the locking block 108, and an aft slide groove tab 270 of an aft trigger housing 122. In some embodiments, the rail grooves 192 extend from the rear end of the slide 104 and terminate near the forward end of the slide 104. The rail grooves 192 provide a generally continuous surface for the forward slide groove tab 166, the locking block 108, and the aft slide groove tab 270 as the slide 104 cycles during use of the handgun 100. In some embodiments, the frame 102 is constructed from a polymer. In this regard, the forward slide groove tab 166 is suitably constructed from a metal alloy for durability during cycling of the slide 104. In these embodiments, the forward slide groove tab 166 is suitably co-molded, press-fit, or fastened to the frame 102.

Although the rail grooves 192 provide travel of the slide 104 with respect to the frame 102 in predominantly a single direction along the length of the slide 104, in some embodiments, the forward slide groove tab 166, the locking block 108, and the aft slide groove tab 270 are sized such that there is a relatively small amount of travel in the directions along the height and width of the slide 104. This movement, often referred to as "play," reduces friction, allows room for lubricant, and provides durability in the parts. In further embodiments, play is reduced by manufacturing the rail grooves 192 and the forward slide groove tab 166, the locking block 108, and the aft slide groove tab 270 to tighter tolerances.

In some uses of the handgun 100, a tighter tolerance in a short recoil section of the rail grooves 192 is desired, such as the duration the projectile is traveling through the barrel. In one instance, full automatic operation, an operating mode where holding the trigger continues to automatically fire cartridges, the short recoil section is beneficial. In other examples of the embodiments herein, the short recoil section is beneficial for semi-automatic operation, where the trigger requires separate actuation for firing each cartridge. In this regard, an otherwise larger tolerance of the rail grooves 192 with respect to the forward slide groove tab 166, the locking block 108, and the aft slide groove tab 270 can be selectively tightened for the short recoil section by using rail groove platforms 194 as shown in FIG. 17. The rail groove platforms 194 provide a segment of the full cycle of the slide 104 with tighter tolerance for less play in the directions other than along the length of the slide 104.

In the illustrated embodiment, the rail groove platforms 194 are located in corresponding positions along the rail grooves 192 on either side of the slide 104 such that the rail groove platforms 194 generally align with the forward slide groove tab 166, the locking block 108, and the aft slide groove tab 270 when the slide 104 is aligned with the frame 102 in firing position. As the handgun 100 is fired, the rail groove platforms 194 provide a tighter slide tolerance in the rail grooves 192 until the slide 104 travels rearward such that the rail groove platforms 194 no longer interface the forward slide groove tab 166, the locking block 108, and the aft slide groove tab 270. In other embodiments, the rail groove platforms 194 are placed in any suitable position along the rail grooves 192 and are of any suitable length in the rail grooves 192.

In full automatic operation embodiments, the full automatic lever 344 is rotated to cause the firing system to continually cycle while the trigger is depressed. The full automatic lever spring clip 346 retains the full automatic lever 344 and provides a rotational spring effect as the full automatic lever 344 is rotated from semi-automatic operation to full automatic operation positions. When the full automatic lever 344 is used to select full automatic operation, a surface on the full automatic lever 344 moves a trigger bar 118 downward to disengage the trigger bar 118 from the firing pin 280 near the end of the cycle of the slide 104. In this manner, while the trigger assembly 120 is retained in the rearward position (i.e., the trigger 250 is pulled), the handgun 100 will continue to fire until the magazine 130 is empty of cartridges.

As shown in FIG. 18, another aspect of the slide 104 will be described in more detail. The barrel protrusion interface surface 198 is shaped to correspond to a forward protrusion interface surface 204 on the barrel protrusion 202 of the barrel 106. The corresponding shapes provide a centering effect when the barrel protrusion interface surface 198 and the forward protrusion interface surface 204 abut. In the illustrated embodiment, the barrel protrusion interface surface 198 and the forward protrusion interface surface 204 are arcuate. However, in other embodiments, the barrel protrusion interface surface 198 and the forward protrusion interface surface 204 have any suitable shape to center the barrel 106 with the slide 104, such as a chamfer, a geometric shape, or a dowel protrusion with a corresponding recess. In another aspect of some of the disclosed embodiments, the disengagement of the barrel protrusion interface surface 198 and the forward protrusion interface surface 204 occurs during the short recoil section of the cycle of the slide 104.

Now referring to FIG. 19, a further aspect of the slide 104 will be described in more detail. The breech face 180 provides a tight interface with the barrel protrusion 202 to reduce the amount of exploding gasses and flames escaping the handgun 100 during operation. Escape of the gasses and flames can cause injury to the user. The breech face 180 includes the firing pin breech face aperture 214 to allow a firing pin 280 (see FIG. 13) to travel through the breech face 180 and strike the primer P of the cartridge C. In this regard, the firing pin breech face aperture 214 is sized to provide clearance for the firing pin 280, but allow interface of the breech face 180 with the interacting face of the barrel protrusion 202 to reduce escape of the gasses and flames.

The breech face 180 also includes the breech face relief recess 212 on the lower side of the firing pin breech face aperture 214. When the firing pin 280 strikes the primer P of the cartridge C, the primer P can swell to bulge from the face of the cartridge C. In some embodiments, upon expelling of the spent cartridge, the cartridge C is first rotated downward closely against the breech face 180. Should the primer P bulge after strike, the breech face relief recess 212 allows further clearance from the breech face 180 such that the primer P does not excessively wear the breech face 180, which can lead to premature replacement of components of the handgun 100.

Figure 5:
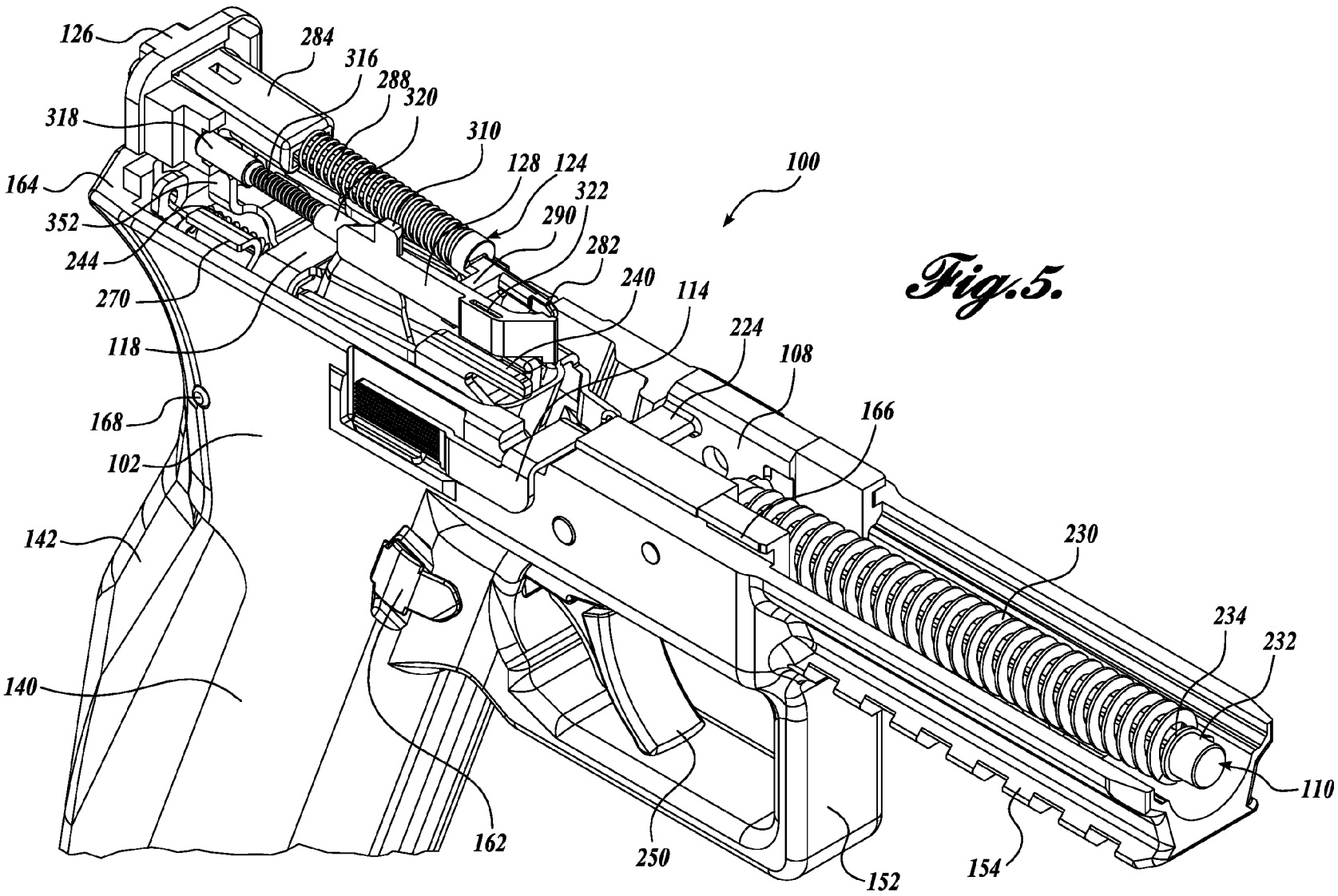
FIG. 5 is a front left top detail view of the handgun of FIG. 1, with slide and barrel components removed to show interior components.

Now turning to FIG. 5, internal components of the handgun 100 are shown with the slide 104 and barrel 106 removed for clarity. In the forward section of the frame 102, a main spring assembly 110 is shown. The main spring assembly 110 includes a main spring 230, the spring rod 232, and a retaining clip 234. The main spring 230 provides a restoring force to the slide 104 during the cycle, returning the slide 104 back to the firing position (as shown in FIGS. 1-4). As the slide 104 begins the cycle, the slide 104 moves rearward along the frame 102 and compresses the main spring 230, either by manual input (the user pulling the slide rearward), or by using forces inherent in the ignition of the gun powder in the cartridge C during firing of the handgun 100. The main spring 230 then expands to move the slide 104 forward and return of the slide 104 to the firing position.

The internal components of the handgun 100, as illustrated in FIGS. 5-8, further include a locking block 108, the trigger bar 118, a firing pin assembly 124, and a backplate 126. As shown most clearly in FIG. 7, the locking block 108 includes a slide lock rod inner aperture 220 for insertion of the slide lock rod 112 and next through a slide lock rod outer aperture 158 (FIG. 7) of the frame 102, a locking block inner aperture 222 for insertion of the locking block aft pin 226 that pins a trigger assembly 120 to the locking block 108 and next through a locking block outer aperture 160 of the frame 102, and a tapered barrel interface protrusion 224. The locking block 108 provides a central mounting location along the frame 102, among other features. In one aspect, the tapered barrel interface protrusion 224 interfaces a lower barrel extension 208 and a locking block interface notch 210 of the barrel 106. In this regard, as the slide 104 and barrel 106 move rearward during the cycle, the barrel 106 tilts down such that the locking block interface notch 210 closely surrounds the tapered barrel interface protrusion 224 to stop the rearward movement of the barrel 106 while the slide 104 continues to travel rearward during the cycle. In this regard, the tilt of the barrel 106 allows more direct insertion of the cartridge C from the magazine 130.

Figure 7:
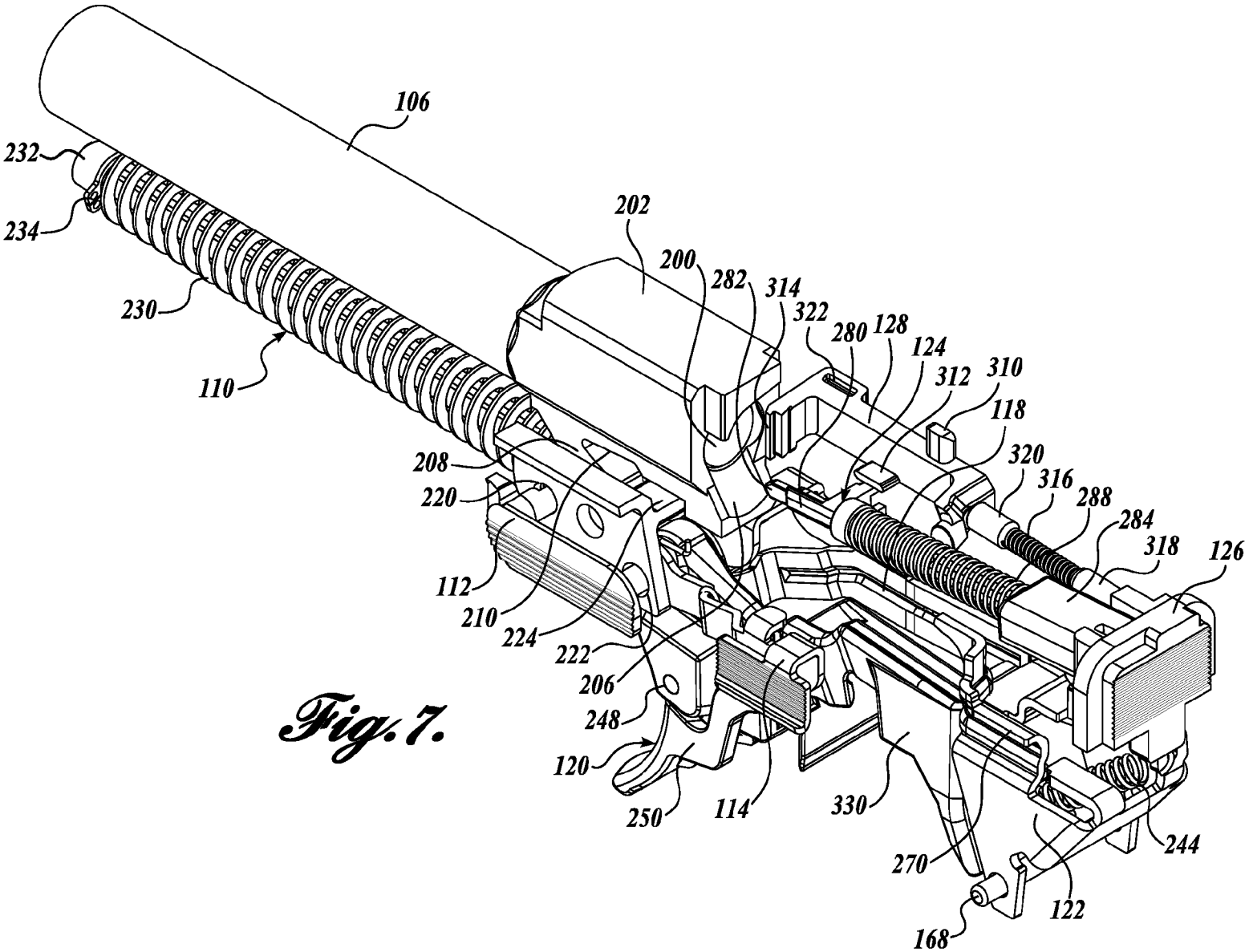
FIG. 7 is a perspective view of the firing subassembly shown in FIG. 6 from another angle and including a barrel.

As shown in FIG. 7, the barrel 106 further includes a chamber 200 corresponding to the size and shape of the cartridge C and a cartridge ramp 206 to aid in guiding the cartridge C into the chamber 200 from a magazine follower 330 of the magazine 130. The magazine follower 330 guides the cartridges in the magazine 130 to the uppermost position such that the slide 104 guides the top cartridge C into the chamber 200 when the slide 104 translates forward during the cycle. In some embodiments, the chamber 200 includes features to prevent the cartridge C from inserting too deeply into the chamber 200. In other embodiments, the cartridge C includes features to prevent deep insertion into the chamber 200, such as a belt (not shown). In other embodiments, the cartridge ramp 206 is polished to a low friction surface to aid in insertion of the cartridge C.

Figure 21:
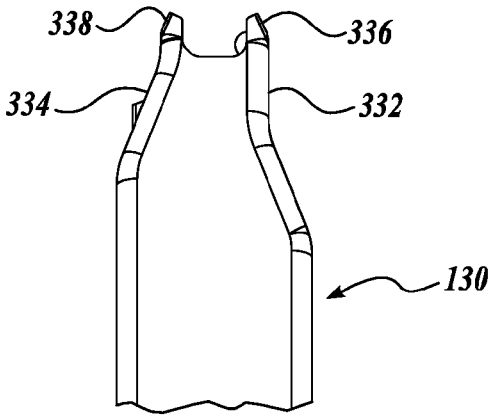
FIG. 21 is a fragmentary detail view of an upper portion of a magazine of the handgun of FIG. 1.

As shown in FIG. 21, the magazine 130 includes the magazine follower 330, an asymmetrical lower surface 332, and an asymmetrical upper surface 334. The configuration of the asymmetrical lower surface 332 and the asymmetrical upper surface 334 increases the volume to provide a higher carrying capacity of the magazine 130. In another aspect the asymmetrical lower surface 332 and the asymmetrical upper surface 334 provide compact packaging of the magazine 130.

Figure 6:
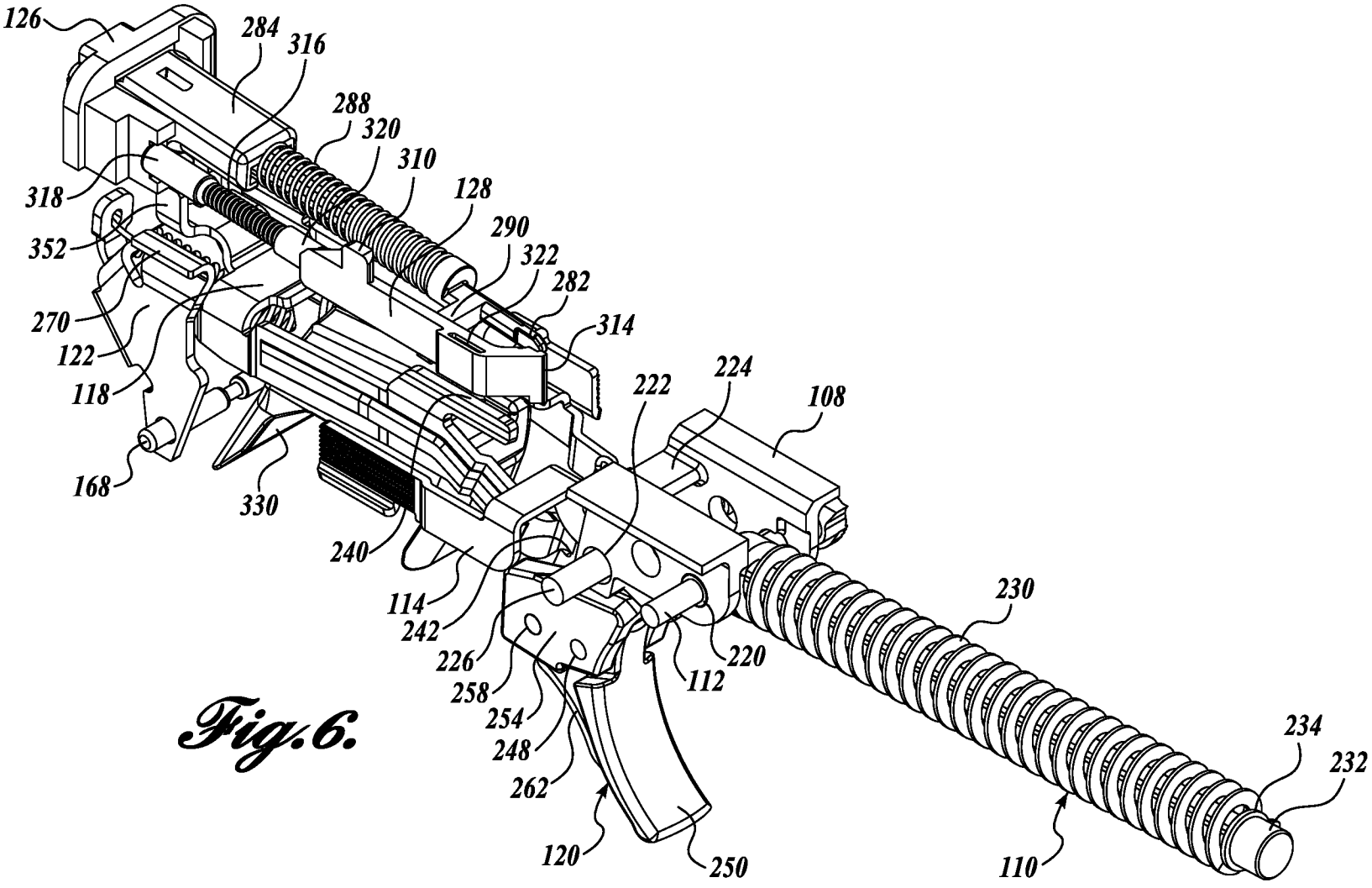
FIG. 6 is a perspective view showing a firing subassembly of the handgun of FIG. 1.

Turning now to FIG. 6, the extractor 128 further includes an extractor upper protrusion 310, and extractor lateral protrusion 312 (see FIG. 7), which will be described in greater detail below, a cartridge rim protrusion 314, an extractor spring 316, an extractor bar 318, and an extractor pin 320. The extractor upper protrusion 310 provides complete coverage of the extractor slot 184. The extractor upper protrusion 310 corresponds with the shape of the extractor slot 184, which is shaped to allow clearance from the firing pin 280 during assembly of the mechanism. In other embodiments, the extractor upper protrusion 310 is omitted or shaped to closely match the extractor slot 184.

The cartridge rim protrusion 314 is configured to engage a rim on the rear surface of the cartridge C to provide an interface such that the spent cartridge, or a cartridge in the case of unloading, is pulled out of the chamber 200 and discarded laterally away from the handgun 100 when the cartridge C interfaces an ejector extension 272 stationary on the aft trigger housing 122. As the cartridge C is pulled rearward by the cartridge rim protrusion 314, the cartridge C interfaces the ejector extension 272, which imparts a rotational moment to the spent cartridge, causing lateral ejection of the cartridge C away from the slide 104. The removal of the spent cartridge clears the chamber 200 for loading of an unspent cartridge C for the next firing cycle.

The extractor 128 generally travels with the slide 104 during the cycle which pulls the spent cartridge out of the chamber 200 during the rearward movement. The extractor 128 is positioned in the extractor slot 184 of the slide 104 that provides interference from movement in the direction of the height of the slide 104 and the direction of the length of the slide 104. The extractor 128 is restricted by movement in the lateral direction away from the slide 104 by the extractor pin 320 and the extractor spring 316. In the illustrated embodiment, the extractor pin 320 is attached to the extractor 128. The extractor bar 318 is located in an aperture in the slide (not shown) and compresses the extractor spring 316 against the extractor pin 320 to provide resistance from lateral movement away from the slide 104. In this manner, the extractor spring 316 applies a restoring force to keep the extractor 128 in the extractor slot 184, but allows lateral movement to accept the cartridge C. In a further aspect, the extractor bar 318 provides a locking function for the backplate 126. In this embodiment, the extractor bar 318 is compressed prior to removal of the backplate 126 for disassembly of the backplate 126.

In a further aspect of the present disclosure, the extractor 128 includes a chambered round indicator 322. In this regard, when a cartridge is not inserted in the chamber 200, the extractor 128 abuts the inner surface of the extractor slot 184, closer to the centerline of the slide in the lateral direction. As a result, the chambered round indicator 322 is not visible on the outside of the handgun 100 because it is obscured by the edge of the extractor slot 184 of the slide 104. When a cartridge C is inserted into the chamber 200, the cartridge rim protrusion 314 interfaces the rim of the cartridge C such that the extractor 128 is shifted laterally in the extractor slot 184, revealing the chambered round indicator 322. In this manner, the chambered round indicator 322 acts as a visual cue that the cartridge C is chambered and the handgun 100 will generally fire when the trigger 250 is actuated. In some embodiments, the chambered round indicator 322 is painted with high-visibility paint. In other embodiments, a light emitting or reflecting substance is used, such as the radioactive isotope, tritium, to provide more visibility in low or absent ambient light conditions.

Figure 8:
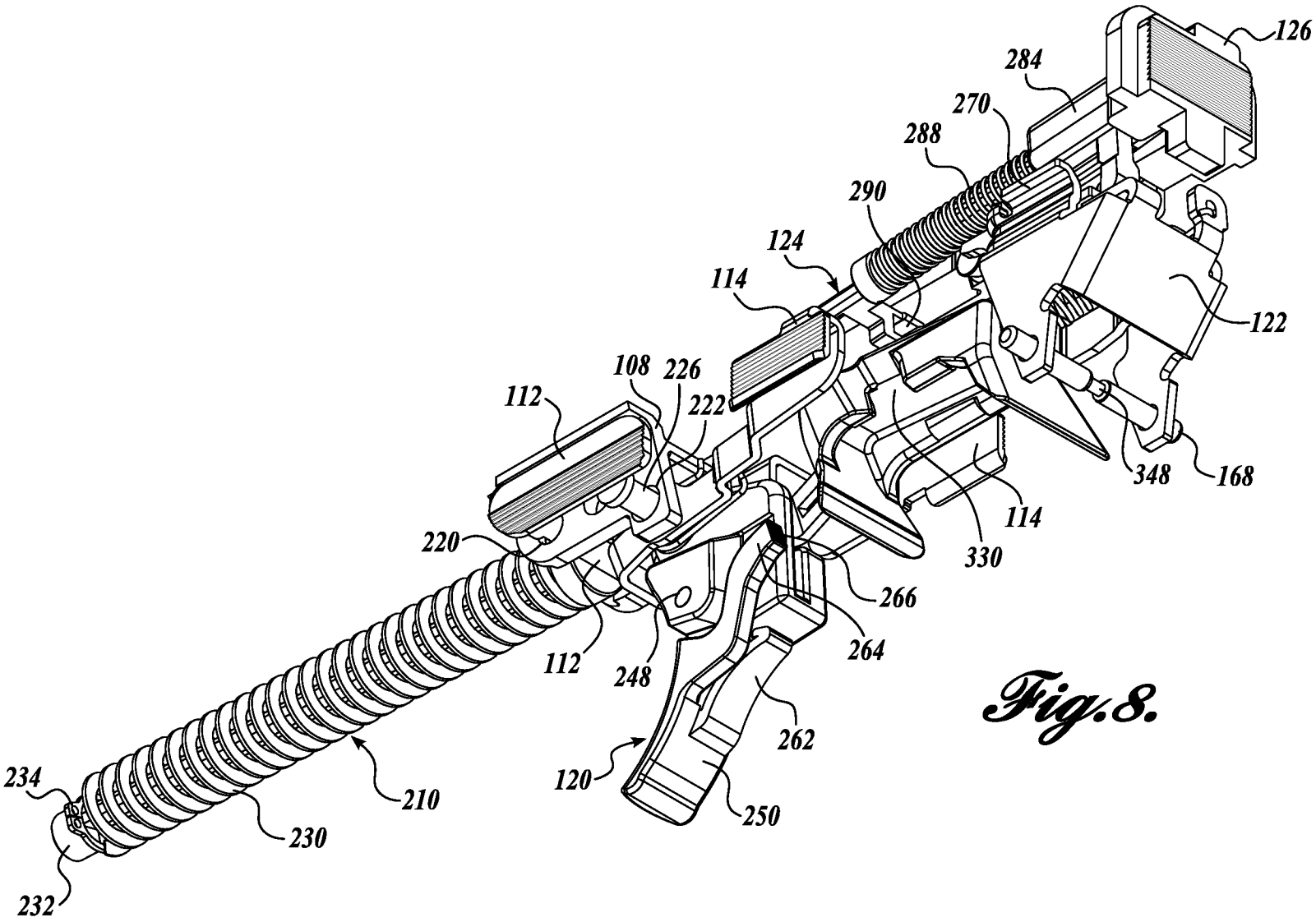
FIG. 8 is another view of the firing subassembly shown in FIG. 6.
Figure 9:
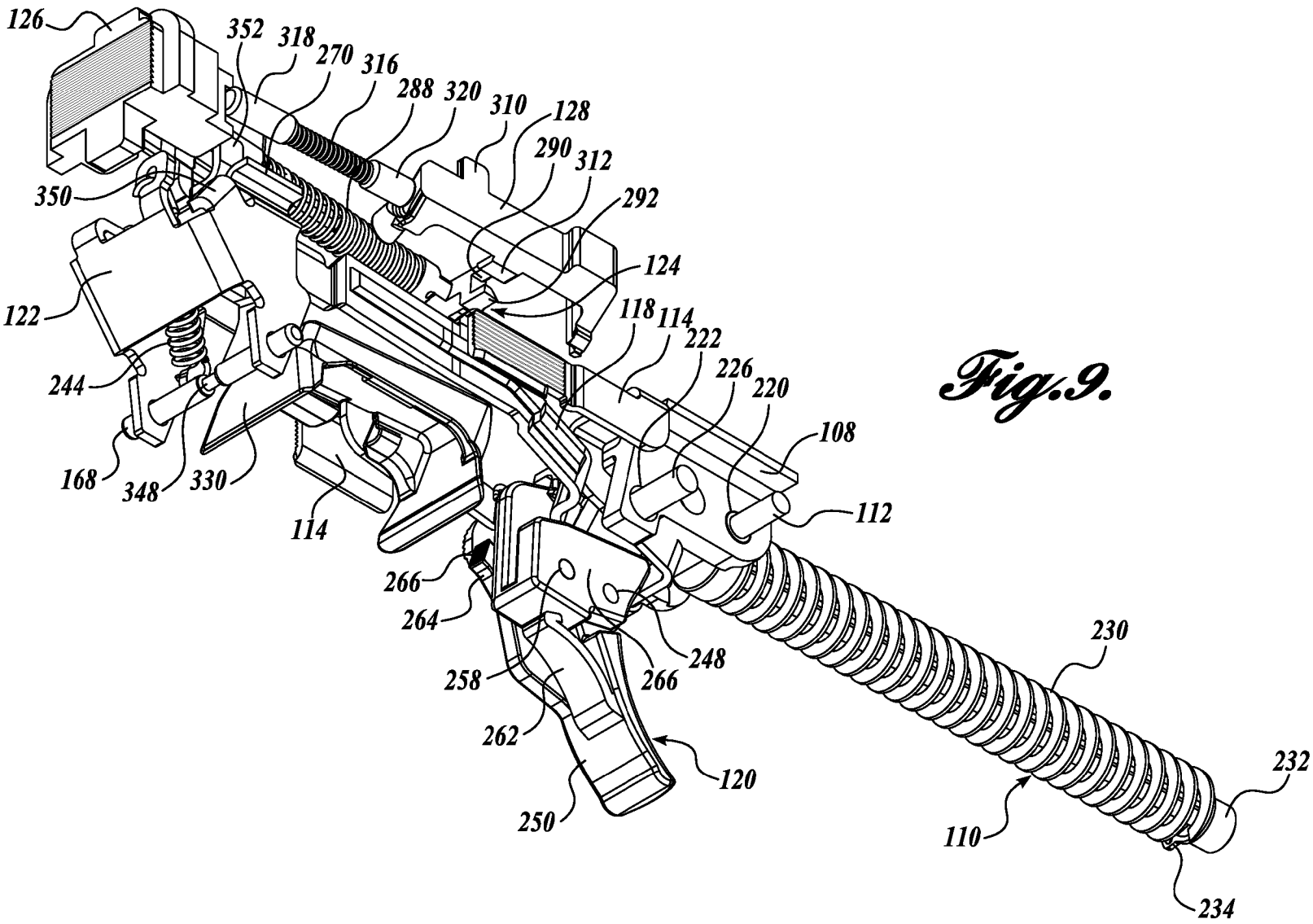
FIG. 9 is another view of the firing subassembly shown in FIG. 6.

Next, the assemblies of the firing system of the handgun 100 will be described in more detail as related to FIGS. 8-12. Turning first to FIGS. 8 and 9, the trigger assembly 120 pivots around the locking block aft pin 226 through a trigger hinge pivot aperture 256 (see FIG. 10) located in a trigger hinge 254. In the illustrated embodiment, the trigger assembly 120 comprises the trigger 250 and the trigger hinge 254. In other embodiments, the trigger assembly 120 is suitably a single component or more than two components.

Figure 15:
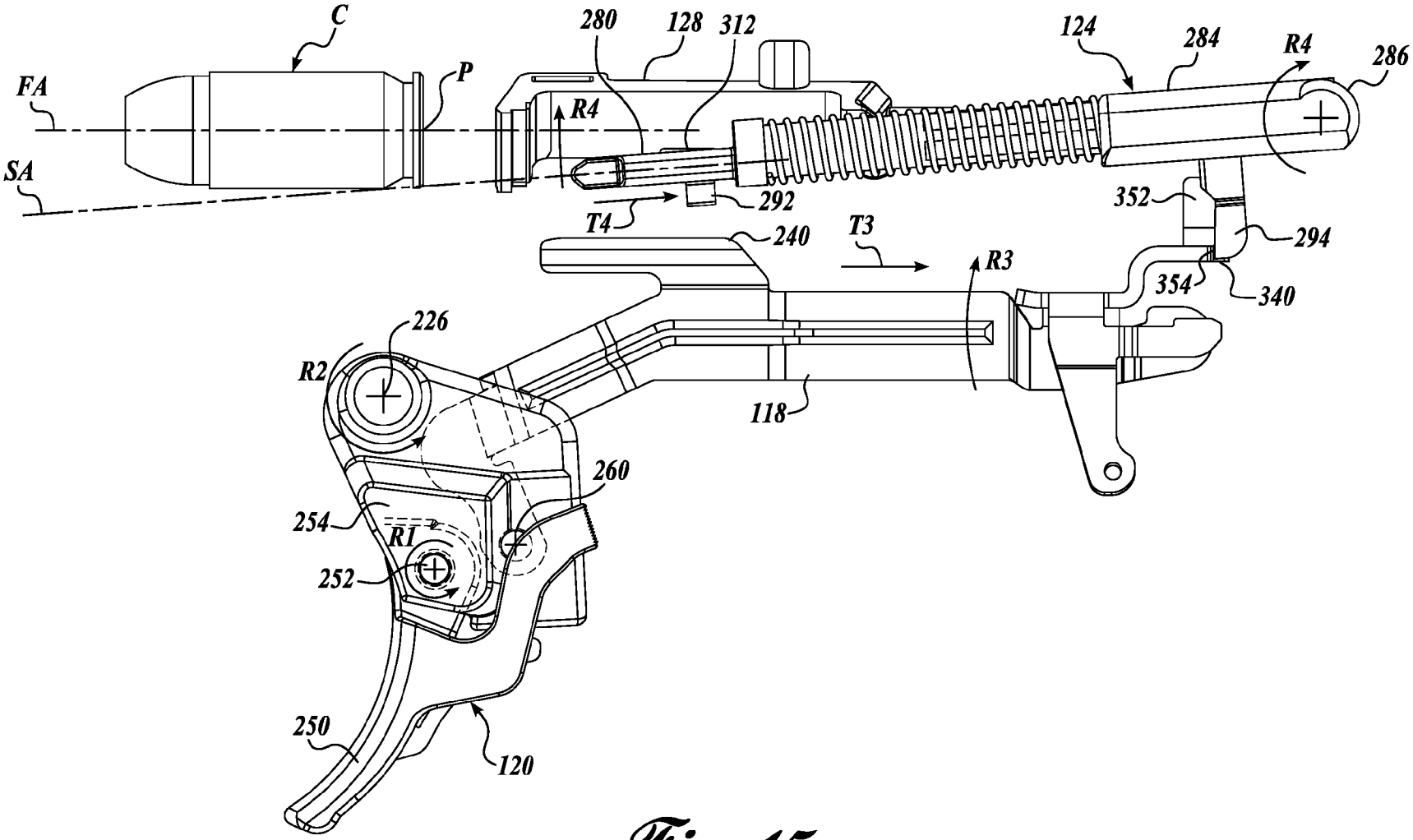
FIG. 15 is a right elevational view of the assembly of FIG. 14, showing the firing sequence movement of the components with the firing pin aligned along the safe axis.

The illustrated embodiment of the trigger 250 employs various features to provide safety, ergonomics, and repeatability to the firing function of the handgun 100. As shown most clearly in FIGS. 10 and 11, the trigger 250 includes a trigger pivot aperture 246 for insertion of a trigger pivot pin 252, a trigger spring 262, and a trigger protrusion 264 having trigger protrusion surface treatment 266 (i.e., a friction increasing treatment). The trigger spring 262 abuts the lower surface of the trigger hinge 254 (see FIG. 9) and provides a restoring force to the trigger 250 such that the trigger 250 is returned to the forward position (as shown in FIG. 15 in comparison to FIG. 16) absent an external force. In some embodiments, the trigger spring 262 is an integral portion of the trigger 250, for example, a protrusion molded in plastic exhibiting elastic deformation in the range of the rotation of the trigger 250 during operation. In other embodiments, the trigger spring 262 is suitably a separate component in the trigger assembly 120. The trigger protrusion 264 is one aspect of the safety features of the present disclosure. In one embodiment, the trigger protrusion 264 is configured to abut a surface on the frame 102 (surface not shown) if the trigger 250 is not intendedly actuated by the user. If the trigger assembly 120, alone, is rotated about the locking block aft pin 226 without the trigger 250 first being rotated about the trigger pivot pin 252, the trigger protrusion 264 will abut the frame 102 and prevent further actuation of the trigger assembly 120. In some embodiments, the trigger protrusion 264 is an integral portion of the trigger 250, for example, a protrusion molded in plastic. In other embodiments, the trigger protrusion 264 is suitably a separate component in the trigger assembly 120.

As a further aspect, in other embodiments, the trigger protrusion 264 includes the trigger protrusion surface treatment 266 to provide increased friction between the trigger protrusion 264 and the frame 102. In this embodiment, the surface of the frame 102 includes corresponding surface treatment to provide an interlocking effect. In absence of the trigger protrusion surface treatment 266 and corresponding surface treatment on the surface of the frame 102, increasing the force on the trigger assembly 120 may cause the trigger protrusion 264 to deflect and/or slip past the surface on the frame 102 such that the safety feature malfunctions. Although the illustrated embodiments show the surface treatment as a linear peak and valley configuration, in other embodiments, the surface treatment is suitably any friction increasing treatment. As an additional safety feature, in some embodiments, if additional force is applied to the trigger 250 after the trigger protrusion 264 abuts the frame 102, the location of the pivot points on the trigger hinge 254 tend to result in a force that returns the trigger hinge 254 to the forward location.

Figure 10:
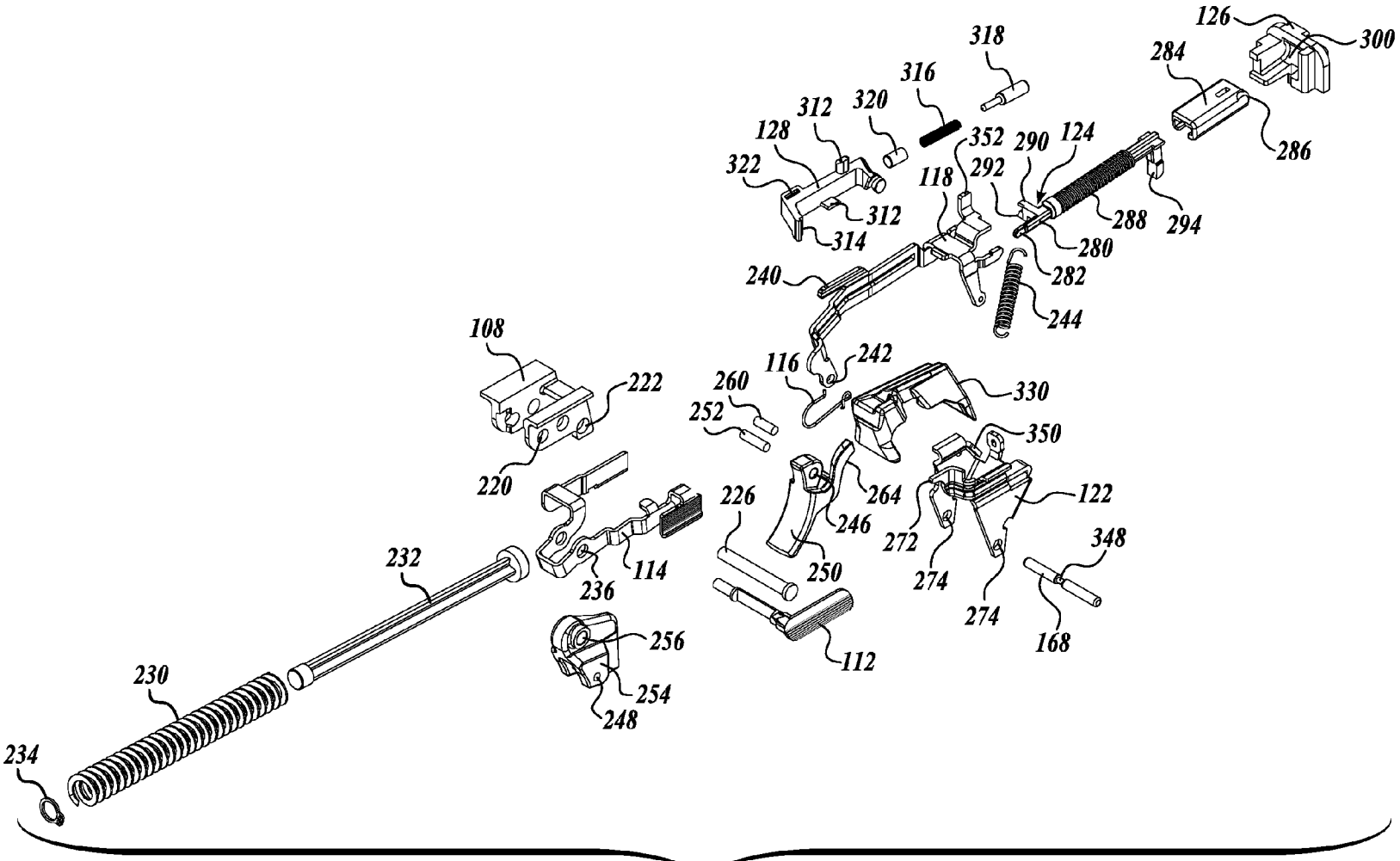
FIG. 10 is an exploded view of the firing subassembly shown in FIG. 6.
Figure 11:
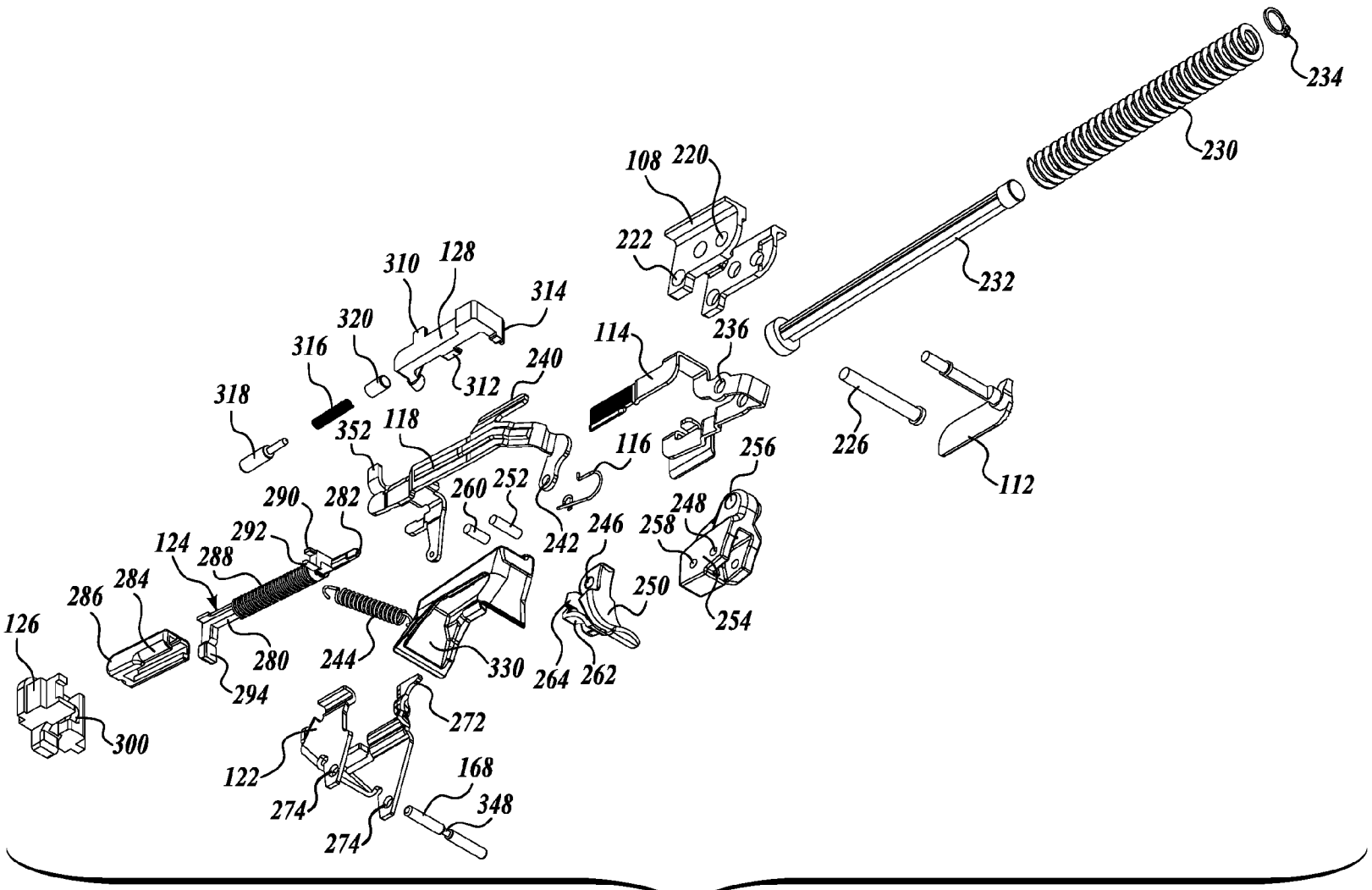
FIG. 11 is another exploded view of the firing subassembly shown in FIG. 6.

Continuing to refer to FIGS. 10 and 11, the trigger hinge 254 provides pivoting and connection functions for the trigger 250, the frame 102, and the trigger bar 118. The trigger hinge 254 includes the trigger hinge pivot aperture 256 for insertion of the locking block aft pin 226, a trigger hinge trigger aperture 248 for insertion of the trigger pivot pin 252 through the trigger pivot aperture 246, and a trigger bar shifting aperture 258 for insertion of a trigger bar shifting pin 260 through a trigger bar shifting point 242. The trigger hinge 254 generally translates the rotational movement of the trigger 250 to a lifting and translation movement to the trigger bar 118 as will be explained in greater detail below with respect to the firing sequence shown in FIGS. 14-16. The trigger hinge 254 is pinned to the frame 102 through the trigger hinge pivot aperture using the locking block aft pin 226. In some embodiments, the trigger hinge 254 is integrated with the trigger 250 such that a single component performs the functions of the trigger hinge 254 and the trigger 250. In other embodiments, more than two components perform the functions of the trigger hinge 254 and the trigger 250.

The trigger bar 118 includes a firing pin protrusion lifting face 240 to provide an interface to the firing pin 280 during the firing sequence. The trigger bar 118 also includes a trigger bar spring 244, a firing pin lateral fixing face 340 and a firing pin retracting face 354 (FIG. 15), and a trigger bar slide interface tab 352 (FIG. 6). The firing pin retracting face 354 interfaces a firing pin translation extension 294, allowing the trigger bar 118 to retract the firing pin 280 within a firing pin sleeve 284. Since the trigger bar 118 is configured for movement in the lateral direction, the firing pin lateral fixing face 340 also interfaces the firing pin translation extension 294 to prevent the trigger bar 118 from displacing toward the center of the handgun 100, causing a misfire of the firing system.

To further prevent a loss of interaction of the firing pin lateral fixing and retracting faces 340 and 354 of the trigger bar 118 and the firing pin translation extension 294, the trigger bar spring 244 is connected to the aft trigger housing 122 to provide a pulling force to an aft end of the trigger bar 118. In this regard, the trigger bar spring 244 tends to pull the trigger bar 118 rearward, upward, and to the side of the slide 104 with the extractor slot 184 Likewise, in some embodiments, interaction of the trigger bar 118 with a protrusion (not shown) on the frame 102 maintains the trigger bar 118 in an upward position, which prevents accidental discharge if the handgun 100 is dropped. As a further aspect, to prevent the trigger bar 118 from translating upward based on the pulling force of the trigger bar spring 244, the trigger bar 118 interacts with the aft housing 122 such that the trigger bar 118 cannot translate upward.

As a result of the foregoing features, the engagement of the trigger bar 118 is maintained with the firing pin 280 until the trigger bar 118 abuts a aft housing tapered surface 350 (FIG. 12) to lower the aft end of the trigger bar 118 and cause the firing pin 280 to disengage from the firing pin lateral fixing and retracting faces 340 and 354 and accelerate forward to strike the primer P. In this embodiment, the firing pin lateral fixing face 340 maintains the trigger bar 118 aligned with the aft housing tapered surface 350 until the said abutment. As the slide 104 completes the cycle, the aft end of the trigger bar 118 stays in the lowered position until the slide 104 moves forward in the cycle and engages the trigger bar 118 at a trigger bar slide interface tab 352 (FIG. 6), which also repositions the trigger bar 118 such that it returns to the lateral position where the firing pin lateral fixing face 340 abuts the firing pin translation extension 294.

Referring briefly back to the slide stop 114, as shown in FIGS. 10 and 11, the slide stop 114 includes a slide stop pivot aperture 236 providing a pined rotation point for the slide stop 114. The slide stop 114 also includes an interface with a slide stop spring 116 to provide a restorative force to the slide stop 114 such that it has a downward rotation tendency to prevent insertion of the slide stop 114. To stop the slide 104 in the rearward position of the cycle after the last cartridge C is ejected, the magazine follower 330 engages with the slide stop 114. The upward force of the magazine follower 330 overcomes the force of the slide stop spring 116 such that the slide stop engages the slide stop cut 190 and stops the slide 104 in the rearward position of the cycle. In this regard, the slide stop 114 does not lock the slide 104 if a subsequent cartridge C is inserted into the chamber 200, but stops the slide 104 in the rearward position of the cycle after the last cartridge C is ejected. As a further aspect of the slide stop 114 function, replacing the empty magazine 130 with a loaded magazine 130 only requires an actuation of the slide stop 114 to release the slide 104, causing a new cartridge C to be inserted in the chamber 200 without the need to manually cycle the slide 104.

The handgun 100 illustrated in the FIGURES includes the firing pin assembly 124 to strike the primer P of the cartridge C as part of the firing sequence. The firing pin assembly 124 includes the firing pin 280 having a primer striker 282 at one end, the firing pin sleeve 284 allowing relative translational movement of the firing pin 280, a firing pin spring 288, an upper firing pin protrusion 290, a lower firing pin protrusion 292, and the firing pin translation extension 294. The firing pin striker 282 is configured to strike the primer P and ignite it upon impact. In this regard, the firing pin spring 288 provides a translational force to accelerate the firing pin 280 into the primer P when the trigger 250 is actuated by the user.

Figure 12:
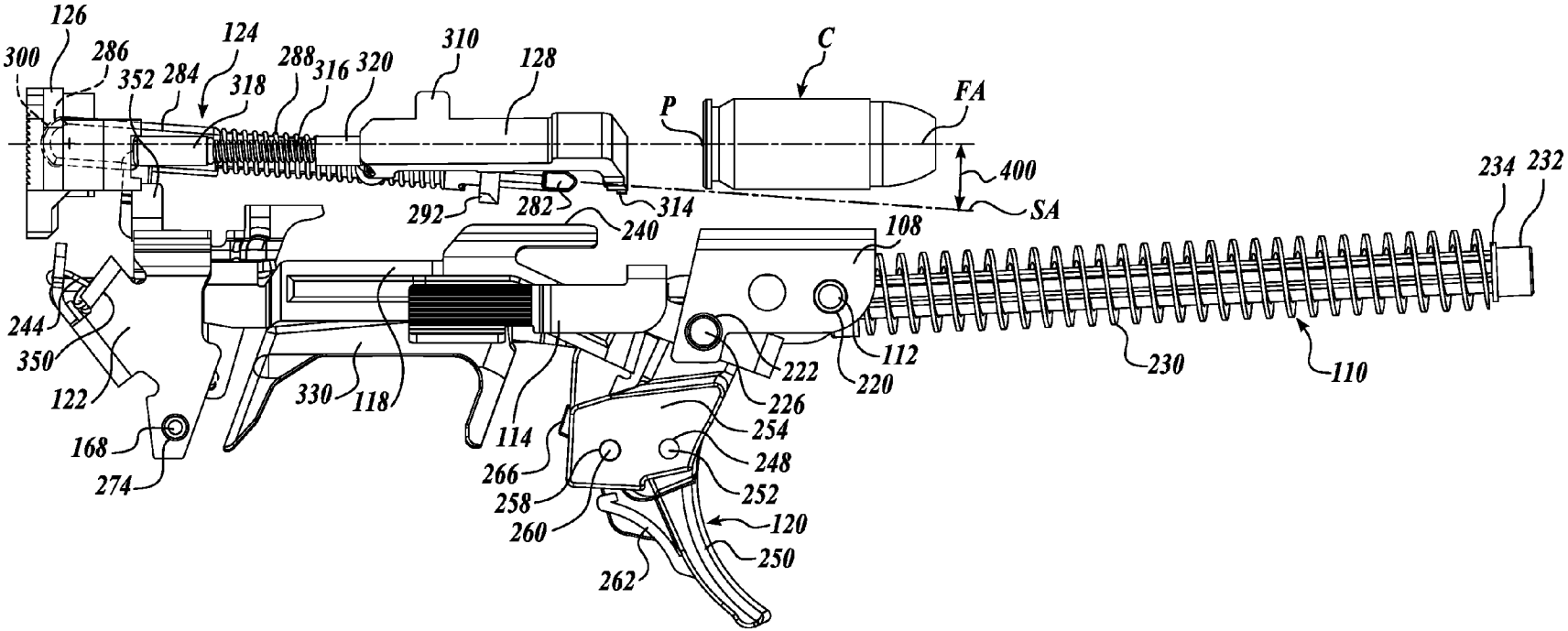
FIG. 12 is a left elevational view of the firing subassembly shown in FIG. 6, showing a cartridge in a firing position.

The firing pin sleeve 284 provides a linear translation path for the firing pin 280 and a surface to compress the firing pin spring 288 as the firing pin 280 is translated rearward during the firing sequence. The trigger bar 118 interfaces the firing pin translation extension 294 to retract the firing pin 280 and compress the firing pin spring 288. In another aspect, the firing pin spring 288 has a stronger interaction with the components than the trigger bar spring 244 such that the firing pin spring 288 tends to return the trigger assembly 120 to the forward position absent an external force acting on the trigger 250. In a further aspect, the firing pin spring 288 is installed in a compressed state such that the firing pin spring 288 provides a force tending to keep the firing pin 280 aligned with a safe axis SA (FIG. 12).

Figure 13:
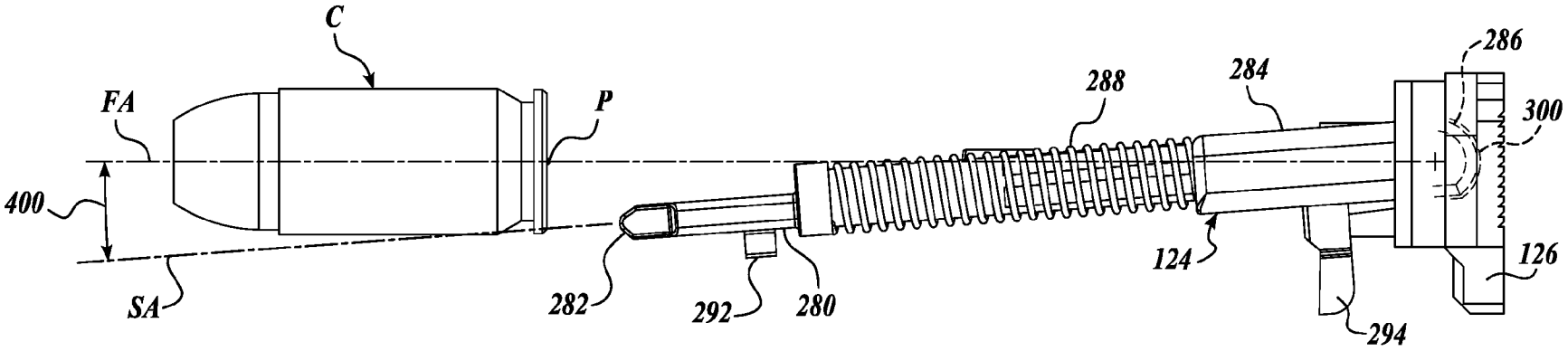
FIG. 13 is a right elevational detail view of a firing pin assembly of the handgun of FIG. 1, showing the offset safe angle of the firing pin with respect to the cartridge.

The safety features of the off-axis firing pin assembly will now be described in more detail. As shown in FIGS. 10-12, the firing pin sleeve 284 includes a firing pin sleeve pivot surface 286 that allows rotation of the firing pin assembly 124 in a plane. The firing pin sleeve 284 undergoes rotation within a firing pin sleeve pivot socket 300 in the backplate 126. In this regard, the firing pin sleeve pivot socket 300 provides a low friction rotation surface for the firing pin sleeve pivot surface 286. As shown in FIGS. 12 and 13, the firing pin assembly 124 rotates from the safe axis SA where the firing pin 280 is not aligned to intersect the primer P, to a firing axis FA where the firing pin 280 is aligned to intersect the primer P and fire the handgun 100. In embodiments, when the firing pin 280 is aligned with the safe axis SA, a release of the firing pin 280 will cause an impact on a surface of the cartridge C or a surface of the handgun 100 other than the primer P.

Figure 14:
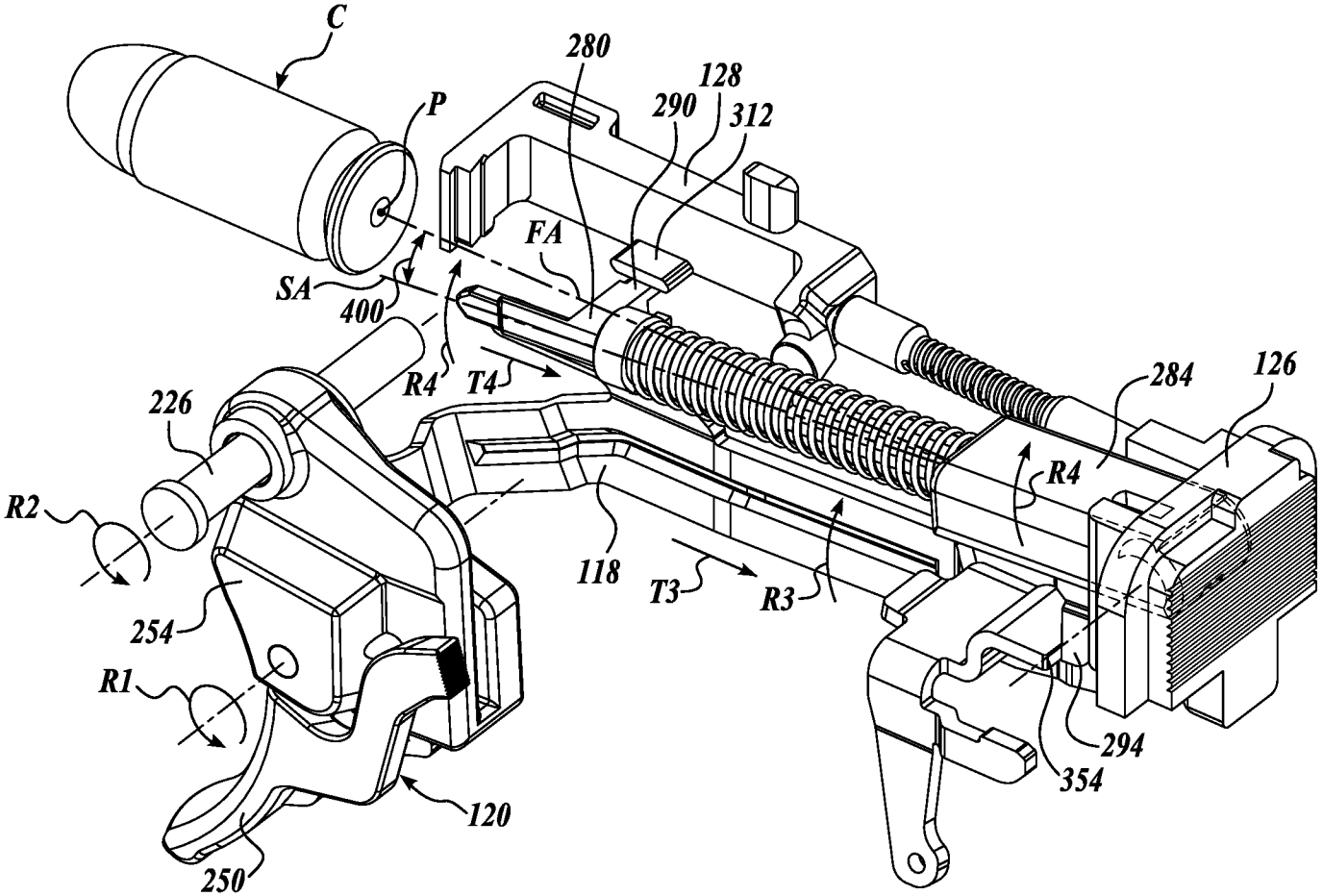
FIG. 14 is a perspective view of an assembly including the firing pin assembly, the backplate, an extractor assembly, a trigger bar, and a trigger assembly of the handgun of FIG. 1, showing the firing sequence movement of the components in accordance with the disclosed embodiments.

As another aspect of the safety features of the handgun 100 of the present disclosure, in some embodiments, the extractor 128 includes the extractor lateral protrusion 312 that interfaces the upper firing pin protrusion 290 as shown most clearly in FIG. 14. In this regard, the firing pin assembly 124 cannot rotate to the firing axis FA without the firing pin 280 first translating rearward to avoid abutting the extractor lateral protrusion 312. To rotate the firing pin assembly 124, in conjunction with the retraction of the firing pin 280, the firing pin protrusion lifting face 240 of the trigger bar 118 abuts the lower firing pin protrusion 292 during the firing sequence. As the firing pin 280 is retracted within the firing pin sleeve 284, the upper firing pin protrusion 290 no longer aligns radially with the extractor lateral protrusion 312, allowing rotation of the firing pin assembly 124 to the firing axis FA. In other embodiments, the upper firing pin protrusion 290 and the lower firing pin protrusion 292 are combined as a single protrusion on the firing pin 280. In further embodiments, the lateral protrusion 312 is located on a component other than the extractor 128, such as the slide 104.

A firing pin angle 400 separates the safe axis SA and the firing axis FA as the firing pin assembly 124 rotates about the pivot defined by the firing pin sleeve pivot surface 286 within the firing pin sleeve pivot socket 300. In some embodiments, the firing pin angle 400 is between about 1 degree and about 15 degrees. In other embodiments the firing pin angle 400 is between about 2 degrees and about 10 degrees. In another embodiment, the firing pin angle 400 is between about 4 degrees and about 6 degrees. Still, in further embodiments, the firing pin angle 400 is equal to or greater than any angle such that the firing pin 280 does not intersect the primer P. Although the illustrated embodiments show the firing pin assembly 124 rotating in the firing pin sleeve pivot socket 300 and into a position to strike the primer P, in other embodiments, the firing pin assembly 124 translates into a position to strike the primer P, or combines rotation and translation to move into a position to strike the primer P.

Turning to FIG. 21, the magazine 130 formed in accordance with one embodiment is shown with an asymmetrical lower surface 332, an asymmetrical upper surface 334, and magazine upper protrusions 336 and 338. The asymmetrical lower and upper surfaces 332 and 334 provide greater carrying capacity to the magazine 130 for an increase in cartridge retention over existing magazines without asymmetric lower and upper surfaces 332 and 334. The magazine upper protrusions 336 and 338 are configured to guide the cartridge into the firing mechanism for loading into the chamber 200.

The firing sequence of the handgun 100, as shown in transition between FIGS. 14 and 15 and FIG. 16, will now be explained in further detail. Referring initially to FIGS. 14-15, a resting safe state of the handgun 100 is shown. The firing sequence of the handgun 100 is denoted by rotational and translational components: a trigger rotation R1, a trigger hinge rotation R2, a trigger bar rotation R3, a trigger bar translation T3, a firing pin rotation R4, and a firing pin translation T4. As shown, initially the firing pin 280 is aligned with the safe axis SA such that the firing pin 280 is not aligned with the primer P. In this respect, even if the handgun 100 is dropped or otherwise impacted, a movement of the firing pin 280 will not cause the handgun 100 to fire.

To begin the firing sequence, the user pulling the trigger 250 initiates a rotation in the direction of the trigger rotation R1. The trigger 250 pivots around the trigger pivot pin 252 until it contacts the trigger hinge 254. The rotation of the trigger 250 in the direction of the trigger rotation R1 bypasses the first safety feature of the trigger protrusion 264 (described in detail above). As the trigger 250 rotates to contact the trigger hinge 254, the trigger protrusion 264 no longer aligns with the frame 102 such that the trigger protrusion 264 does not abut the frame 102 during the rotation of the trigger hinge 254 in the direction of the trigger hinge rotation R2.

Once the trigger 250 contacts the trigger hinge 254, further pulling on the trigger 250 by the user causes the trigger assembly 120 to rotate about the locking block aft pin 226 in the direction of the trigger hinge rotation R2. Concurrently to the rotation of the trigger assembly 120 in the direction of the trigger hinge rotation R2, the trigger bar 118 rotates in the direction of the trigger bar rotation R3 and translates in the direction of the trigger bar translation T3 through the pinned movement of the trigger bar shifting pin 260.

The trigger bar 118 rotating in the direction of the trigger bar rotation R3 and translating in the direction of the trigger bar translation T3 imparts rotation and translation to the firing pin 280. As the trigger bar 118 translates rearward in the direction of the trigger bar translation T3, the interface of the firing pin lateral fixing and retracting faces 340 and 354 of the trigger bar 118 with the firing pin translation extension 294 retracts the firing pin 280 within the firing pin sleeve 284 in the direction of the firing pin translation T4 and compresses the firing pin spring 288.

Likewise, as the trigger bar 118 rotates upward in the direction of the trigger bar rotation R3, after closing the gap between the firing pin protrusion lifting face 240 and the lower firing pin protrusion 292, the trigger bar 118 engages and begins to rotate the firing pin 280 toward the firing axis FA in the direction of the firing pin rotation R4. As previously described, the extractor lateral protrusion 312 is configured to prevent rotation of the firing pin assembly 124 by interfering with the path of the upper firing pin protrusion 290 as the firing pin 280 rotates in the direction of the firing pin rotation R4. In the illustrated embodiment, the gap between the firing pin protrusion lifting face 240 and the lower firing pin protrusion 292 allows the firing pin 280 to translate rearward in the direction of the firing pin translation T4 before the firing pin 280 begins rotation in the direction of the firing pin rotation R4, such that the extractor lateral protrusion 312 no longer interferes with the upper firing pin protrusion 290 as the firing pin 280 rotates in the direction of the firing pin rotation R4.

Figure 16:
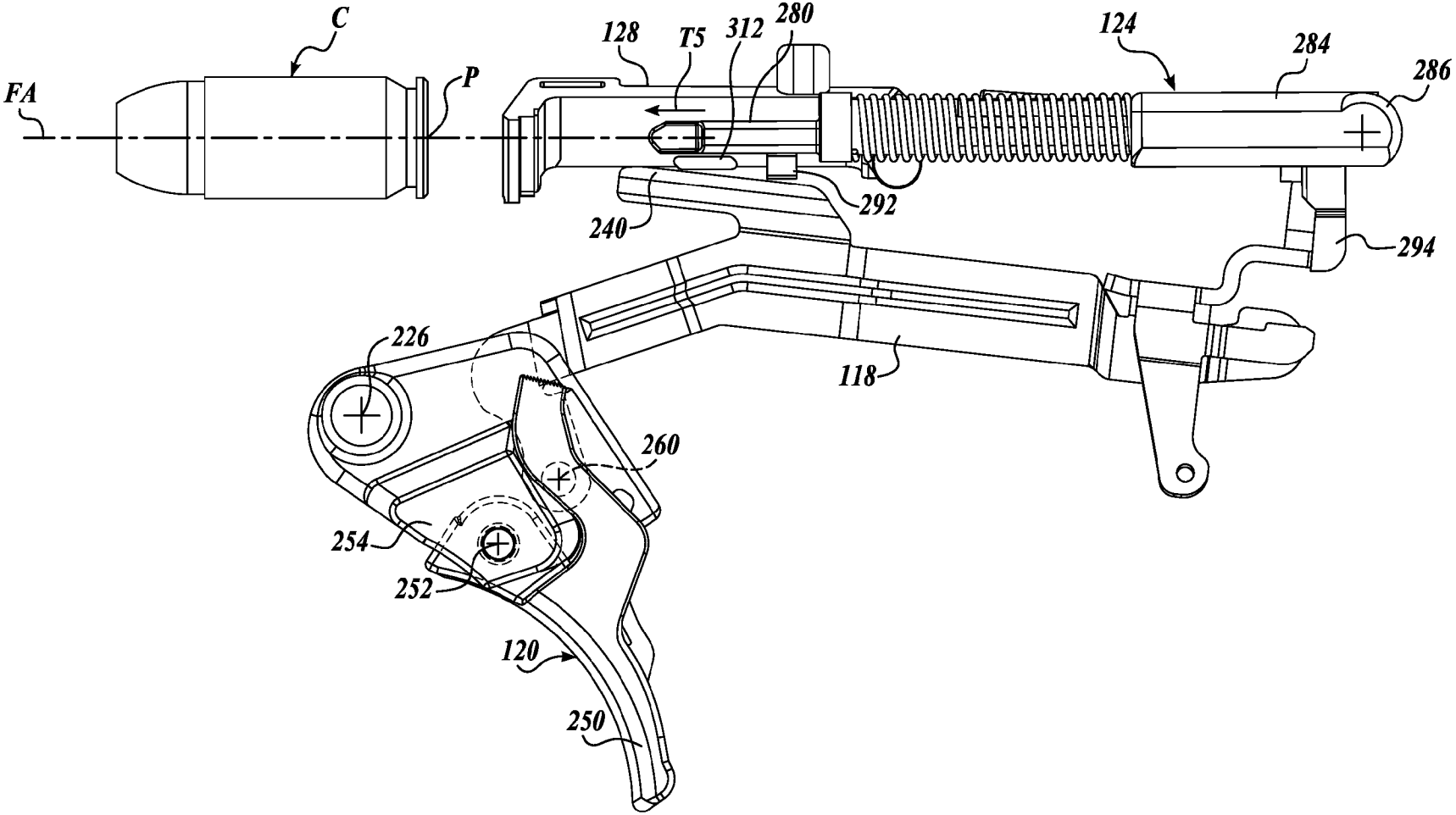
FIG. 16 is a right elevational view of the assembly of FIG. 14, showing the components in transition of the firing pin to the firing axis.

Turning now to FIG. 16, at the end of the trigger assembly 120 rotating in the direction of the trigger hinge rotation R2, the firing pin assembly 124 is aligned with the firing axis FA such that it will strike the primer P by traveling in the direction of a firing pin strike translation T5. The firing pin 280 is retracted by the trigger bar 118 in the direction of the firing pin translation T4 and the firing pin spring 288 is compressed to provide the forward acceleration for the firing pin 280 to strike the primer P. At the end of the rotation of the trigger bar 118 in the direction of the trigger bar rotation R3 and the translation in the direction of the trigger bar translation T3, the firing pin lateral fixing face 340 aligns the trigger bar 118 with the aft housing tapered surface 350 of the aft trigger housing 122 which causes the trigger bar 118 to lower toward the grip 140 and disengage the firing pin lateral fixing and retracting faces 340 and 354 from the firing pin translation extension 294, allowing the firing pin spring 288 to accelerate the firing pin 280 forward in the direction of the firing pin strike translation T5, causing the firing pin 280 to strike the primer P.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A firing mechanism for a firing pin-operated firearm configured to prevent unintended discharge, comprising:

a socket;

a firing pin assembly, comprising:

an elongate firing pin having a shaft defining a firing pin axis and a firing pin protrusion, the firing pin configured to strike a primer of a cartridge with a forward tip portion;

a firing pin sleeve rotatably engaging the socket and slidingly associated with the shaft of the firing pin, the sleeve configured to allow axial movement of the firing pin along the firing pin axis; and a spring abutting the firing pin sleeve for translating the firing pin along the firing pin axis away from the socket;

a trigger assembly configured to translate the firing pin to compress the spring and displace the firing pin assembly from a safety position wherein the firing pin axis is not aligned with the primer of the cartridge, to a firing position wherein the firing pin axis is aligned with the primer of the cartridge; and an extractor having a lateral protrusion positioned to interface with the firing pin protrusion and prevent the firing pin assembly from inadvertently displacing from the safety position until the trigger assembly translates the firing pin into the firing pin sleeve toward the socket such that the firing pin protrusion and the lateral protrusion do not interface when the firing pin assembly displaces to the firing position.

2. The firing mechanism of claim 1, wherein the trigger assembly further comprises:

a trigger hinge member pivotable about a trigger hinge rotation axis, the trigger hinge member configured to translate the firing pin, compress the spring, and displace the firing pin assembly from the safety position to the firing position;

a trigger pinned to the trigger hinge member and pivotable about a trigger rotation axis offset from the trigger hinge rotation axis, the trigger configured to independently pivot about the trigger rotation axis from a safety angle until the trigger abuts the trigger hinge member, wherein thereafter, the trigger pivots together with the trigger hinge member about the trigger hinge rotation axis;

a trigger spring configured to bias the trigger towards the safety angle relative to the trigger hinge member; and a trigger interference protrusion extending from the trigger, wherein the trigger interference protrusion is configured to abut the body portion if the trigger hinge pivots about the trigger hinge rotation axis while the trigger is positioned at the safety angle such that the trigger hinge member cannot displace the firing pin from the safety position until the trigger is first at least partially pivoted about the trigger rotation axis.

3. The firing mechanism of claim 2, wherein the trigger spring returns the trigger to the safety angle absent an external force acting on the trigger.

4. The firing mechanism of claim 2, wherein the trigger interference protrusion includes a high-friction texture on a distal end to resist slip between the trigger interference protrusion and the body portion of the firearm.

5. The firing mechanism of claim 2, wherein the trigger assembly further comprises:

a trigger bar pinned to the trigger hinge member and selectively abutting the firing pin; and a trigger bar spring configured to bias the trigger bar into engagement with the firing pin, wherein the trigger bar is configured to displace the firing pin assembly from the safety position and retract the firing pin within the firing pin sleeve.

6. The firing mechanism of claim 1, wherein the extractor further comprises a visual indicator to alert a user that the cartridge is chambered, the visual indicator configured to allow human eye perception in low or absent ambient light conditions.

7. The firing mechanism of claim 1, wherein the displacement of the firing pin assembly from the safety position is a rotational displacement.

8. The firing mechanism of claim 1, wherein the firing mechanism is modular such that the firing mechanism is capable of installation in any suitable handgun configuration and firing any handgun caliber cartridge.

9. The firing mechanism of claim 1, wherein the firing mechanism is adaptable for installation to a pistol, a handgun, a rifle, or a shotgun.

10. A handgun with a firing pin safety mechanism, the handgun comprising:

a frame;

a slide assembly slidable along the frame, the slide assembly having a socket and a lateral protrusion;

a firing pin assembly, comprising:

an elongate firing pin having a shaft defining a firing pin axis and a firing pin protrusion selectively aligned with the lateral protrusion of the slide assembly, the firing pin configured to strike a primer of a cartridge with a forward tip portion; and a firing pin sleeve rotatably engaging the socket and slidingly associated with the shaft of the firing pin, the sleeve configured to allow axial movement of the firing pin along the firing pin axis;

a trigger assembly pinned to the frame and configured to interface the firing pin assembly within the socket and cause the firing pin to translate and the firing pin axis to displace from a safety position wherein the firing pin axis is not aligned with the primer of the cartridge, to a firing position wherein the firing pin axis is aligned with the primer of the cartridge; and wherein the lateral protrusion of the slide assembly is positioned to interface with the firing pin protrusion and prevent the firing pin assembly from inadvertently displacing from the safety position until the trigger assembly translates the firing pin into the firing pin sleeve toward the socket such that the firing pin protrusion and the lateral protrusion do not interface when the firing pin assembly displaces to the firing position.

11. The handgun of claim 10, wherein the trigger assembly further comprises:

a trigger hinge member pinned to the frame and pivotable about a trigger hinge rotation axis, the trigger hinge member configured to translate the firing pin toward the socket and displace the firing pin assembly from the safety position to the firing position;

a trigger pinned to the trigger hinge member and pivotable about a trigger rotation axis offset from the trigger hinge rotation axis, the trigger configured to independently pivot about the trigger rotation axis from a safety angle until the trigger abuts the trigger hinge member, wherein thereafter, the trigger pivots together with the trigger hinge member about the trigger hinge rotation axis;

a trigger spring configured to bias the trigger towards the safety angle relative to the trigger hinge member; and a trigger interference protrusion extending from the trigger, wherein the trigger interference protrusion is configured to abut the frame if the trigger hinge pivots about the trigger hinge rotation axis while the trigger is positioned at the safety angle such that the trigger hinge member cannot displace the firing pin from the safety position until the trigger is first at least partially pivoted about the trigger rotation axis.

12. The handgun of claim 11, wherein the trigger spring returns the trigger to the safety angle absent an external force acting on the trigger.

13. The handgun of claim 11, wherein the trigger assembly further comprises:

a trigger bar pinned to the trigger hinge member and selectively abutting the firing pin; and a trigger bar spring configured to bias the trigger bar into engagement with the firing pin, wherein the trigger bar is configured to displace the firing pin assembly from the safety position and retract the firing pin within the firing pin sleeve.

14. The handgun of claim 13, wherein the firing pin and trigger bar spring maintain a path of the trigger bar while the trigger hinge member pivots about the trigger hinge rotation axis such that the trigger bar abuts a surface of the frame to disengage the firing pin from the trigger bar, thereby releasing the firing pin to strike the primer.

15. The handgun of claim 13, wherein the slide assembly engages the trigger bar during a cycle of the slide assembly to reengage the trigger bar and the firing pin.

16. The handgun of claim 10, further comprising:

a barrel having a protrusion with a slide assembly interface surface, and a chamber inside the protrusion configured to receive the cartridge, the barrel defining a barrel axis; and a cavity in the slide assembly including a barrel protrusion interface surface, the cavity configured to closely engage the protrusion of the barrel, wherein the barrel axis is centered laterally in the slide assembly by the abutment of the slide assembly interface surface and the barrel protrusion interface surface.

17. The handgun of claim 16, wherein the cavity of the slide assembly further comprises a breech face having a relief groove for clearance of the primer during cartridge ejection.

18. The handgun of claim 16, further comprising a magazine insertable into the frame, the magazine configured to position at least one cartridge for loading into the chamber, wherein the magazine has an asymmetrical taper at an upper end.

19. The handgun of claim 16, wherein the slide assembly further comprises a tapered barrel aperture for relief of angular rotation of the barrel axis.

20. The handgun of claim 10, wherein the slide assembly further comprises a rail groove to slidably interface a tab connected to the frame.

21. The handgun of claim 20, wherein the rail groove includes a platform aligned with the tab of the frame and configured to restrict movement of the tab normal to the direction along the rail groove for short recoil operation of the slide assembly.

22. The handgun of claim 10, wherein the slide assembly includes a surface to enhance grip during manipulation of the slide assembly.

23. The handgun of claim 10, wherein the slide assembly includes a lateral protrusion on the outer surface of the slide assembly to enhance grip during manipulation of the slide assembly.

24. The handgun of claim 10, further comprising a lever insertable into the slide assembly and configured to transition the handgun to full automatic operation.

25. The handgun of claim 10, wherein the displacement of the firing pin assembly from the safety position is a rotational displacement.

26. The handgun of claim 10, wherein the frame comprises a grip portion including a slot for interfacing a groove in a strap, the strap including a strap spring, wherein the strap integrates as part of the grip portion when secured, and wherein the strap spring is configured to secure a strap pin to the frame.

27. The handgun of claim 26, wherein the strap is configured to allow a user to adjust the sizing of the grip portion.

* * * * *